US008299967B2

(12) United States Patent
Xu et al.

(10) Patent No.: US 8,299,967 B2
(45) Date of Patent: Oct. 30, 2012

(54) NON-PLANAR METAMATERIAL ANTENNA STRUCTURES

(75) Inventors: Nan Xu, Carlsbad, CA (US); Sunil Kumar Rajgopal, San Diego, CA (US); Norberto Lopez, San Diego, CA (US); Vaneet Pathak, San Diego, CA (US); Ajay Gummalla, San Diego, CA (US); Gregory Poilasne, El Cajon, CA (US); Maha Achour, San Diego, CA (US)

(73) Assignee: Tyco Electronics Services GmbH (CH)

( * ) Notice: Subject to any disclaimer, the term of this patent is extended or adjusted under 35 U.S.C. 154(b) by 613 days.

(21) Appl. No.: 12/465,571

(22) Filed: May 13, 2009

(65) Prior Publication Data

US 2009/0295660 A1 Dec. 3, 2009

Related U.S. Application Data

(60) Provisional application No. 61/056,790, filed on May 28, 2008.

(51) Int. Cl.
*H01Q 1/38* (2006.01)

(52) U.S. Cl. ..... 343/700 MS; 343/702

(58) Field of Classification Search ..... 343/700 MS, 343/702, 848

See application file for complete search history.

(56) References Cited

U.S. PATENT DOCUMENTS

| | | | | |
|---|---|---|---|---|
| 7,102,578 | B2 * | 9/2006 | Minemura | 343/702 |
| 2008/0048917 | A1 | 2/2008 | Achour et al. | |
| 2008/0079638 | A1 | 4/2008 | Choi et al. | |
| 2008/0258981 | A1 | 10/2008 | Achour et al. | |
| 2009/0128446 | A1 | 5/2009 | Gummalla et al. | |
| 2009/0135087 | A1 | 5/2009 | Gummalla et al. | |
| 2011/0227795 | A1 | 9/2011 | Lopez et al. | |

FOREIGN PATENT DOCUMENTS

| | | |
|---|---|---|
| WO | 2007127955 | 8/2007 |
| WO | WO-2009154907 A2 | 12/2009 |

OTHER PUBLICATIONS

Caloz and Itoh, *Electromagnetic Metamaterials: Transmission Line Theory and Microwave Applications*, John Wiley & Sons (2006).

Itoh, T., "Invited Paper: Prospects for Metamaterials," Electronics Letters, 40(16):972-973, Aug. 2004.

U.S. Appl. No. 61/056,790, filed May 28, 2008, entitled "Non-Planar Metamaterial Antenna Structures" by Xu et al.

Stoytchev, M., et al. "Beyond 3G: Metamaterials application to the air interface." Proceedings of 2007 IEEE Antennas and Propagation Society International Symposium. Honolulu, HI USA. Jun. 10-15, 2007. pp. 1160-1163.

International Search Report and Written Opinion dated Dec. 28, 2009 for International Application No. PCT/US2009/044039 filed May 14, 2009 (11 pages).

* cited by examiner

*Primary Examiner* — Tan Ho

(74) *Attorney, Agent, or Firm* — Schwegman, Lundberg & Woessner, P.A.

(57) ABSTRACT

Antennas for wireless communications based on metamaterial (MTM) structures to arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device.

41 Claims, 31 Drawing Sheets

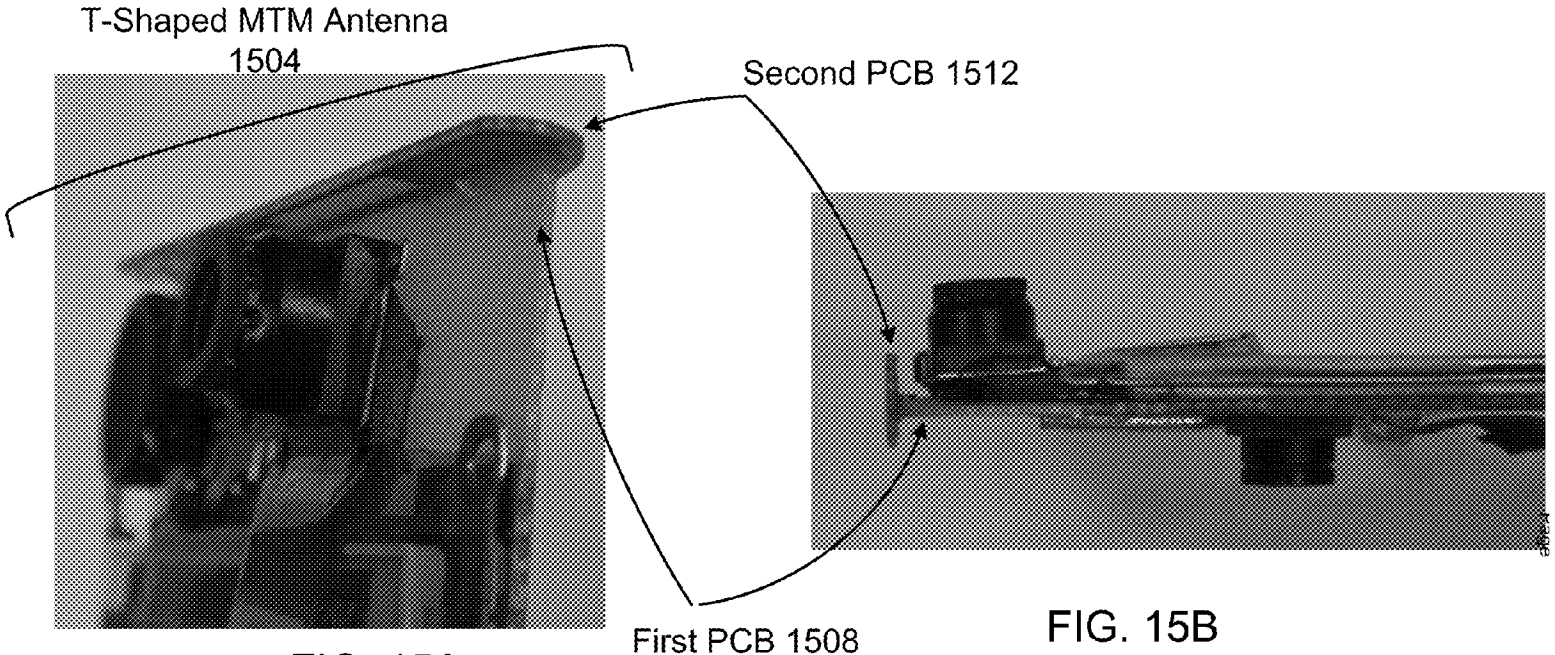
FIG. 15A
FIG. 15B
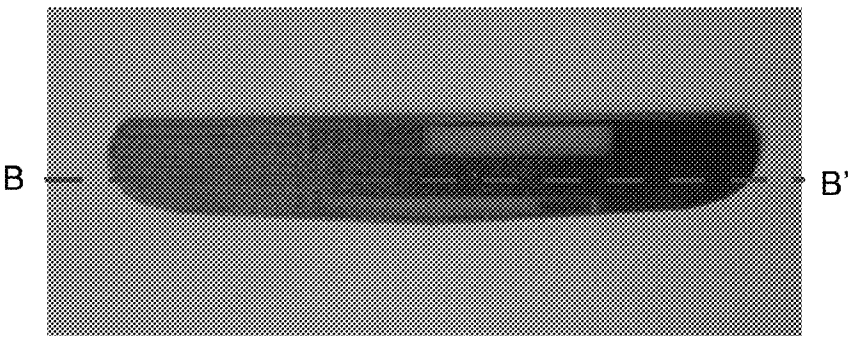
FIG. 15C

NON-PLANAR METAMATERIAL ANTENNA STRUCTURES

PRIORITY CLAIM AND RELATED APPLICATION

This patent document claims the benefit of the U.S. Provisional Patent Application Ser. No. 61/056,790 entitled "Non-Planar Metamaterial Antenna Structures" and filed on May 28, 2008. The entire disclosure of the provisional application is incorporated herein by reference.

BACKGROUND

This document relates to non-planar antenna devices based on metamaterial structures.

The propagation of electromagnetic waves in most materials obeys the right-hand rule for the (E,H,β) vector fields, where E is the electrical field, H is the magnetic field, and β is the wave vector (or propagation constant). The phase velocity direction is the same as the direction of the signal energy propagation (group velocity) and the refractive index is a positive number. Such materials are "right handed (RH)" materials. Most natural materials are RH materials. Artificial materials can also be RH materials.

A metamaterial (MTM) has an artificial structure. When designed with a structural average unit cell size ρ much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation where the relative directions of the (E,H,β) vector fields follow the left-hand rule. Metamaterials that support only a negative index of refraction with permittivity ϵ and permeability μ being simultaneously negative are pure "left handed (LH)" metamaterials.

Many metamaterials are mixtures of LH metamaterials and RH materials and thus are Composite Right and Left Handed (CRLH) metamaterials. A CRLH metamaterial can behave like a LH metamaterial at low frequencies and a RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004). CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

Implementations of designs and techniques are described to provide antennas for wireless communications based on metamaterial (MTM) structures to arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device.

In one aspect, an antenna device is disclosed to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a composite right and left handed (CRLH) metamaterial (MTM) antenna supporting at least one resonance frequency in an antenna signal and having a dimension less than one half of one wavelength of the resonance frequency.

In another aspect, an antenna device is provided and structured to engage an packaging structure. This antenna device includes a first antenna section configured to be in proximity to a first planar section of the packaging structure and the first antenna section includes a first planar substrate, and at least one first conductive part associated with the first planar substrate. A second antenna section is provided in this device and is configured to be in proximity to a second planar section of the packaging structure. The second antenna section includes a second planar substrate, and at least one second conductive part associated with the second planar substrate. This device also includes a joint antenna section connecting the first and second antenna sections. The at least one first conductive part, the at least one second conductive part and the joint antenna section collectively form a composite right and left handed (CRLH) metamaterial structure to support at least one frequency resonance in an antenna signal.

In yet another aspect, an antenna device is structured to engage to an packaging structure and includes a substrate having a flexible dielectric material and two or more conductive parts associated with the substrate to form a composite right and left handed (CRLH) metamaterial structure configured to support at least one frequency resonance in an antenna signal. The CRLH metamaterial structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

These and other aspects, and their implementations and variations are described in detail in the attached drawings, the detailed description and the claims.

BRIEF DESCRIPTION OF THE DRAWINGS

FIGS. 15A and 15B show photos of the 3D view and side view, respectively, of an exemplary T-shaped MTM antenna.

FIG. 15C shows a photo of the top layer of the vertical section of the T-shaped MTM antenna.

DETAILED DESCRIPTION

Figure 1:
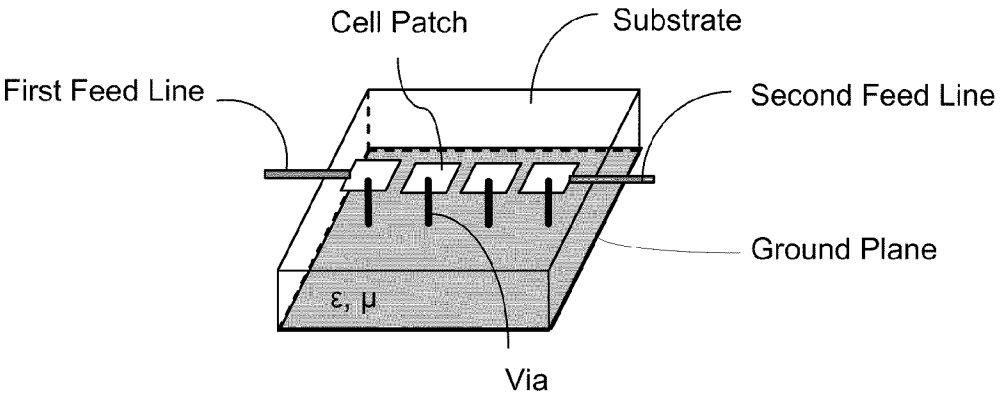
FIG. 1 shows an example of a 1D CRLH MTM TL based on four unit cells.

Metamaterial (MTM) structures can be used to construct antennas, transmission lines and other RF components and devices, allowing for a wide range of technology advancements such as functionality enhancements, size reduction and performance improvements. The MTM structures can be implemented based on the CRLH unit cells by using distributed circuit elements, lumped circuit elements or a combination of both. Such MTM structures can be fabricated on various circuit platforms, including circuit boards such as a FR-4 Printed Circuit Board (PCB) or a Flexible Printed Circuit (FPC) board. Examples of other fabrication techniques include thin film fabrication techniques, system on chip (SOC) techniques, low temperature co-fired ceramic (LTCC) techniques, and monolithic microwave integrated circuit (MMIC) techniques.

The MTM antenna structures can be designed for various applications, including cell phone applications, handheld communication device applications (e.g., PDAs and smart phones), WiFi applications, WiMax applications and other wireless mobile device applications, in which the antenna is expected to support multiple frequency bands with adequate performance under limited space constraints. These MTM antenna structures can be adapted and designed to provide one or more advantages over other antennas such as compact sizes, multiple resonances based on a single antenna solution, resonances that are stable and do not shift substantially with the user interaction, and resonant frequencies that are substantially independent of the physical size. Furthermore, elements in such an MTM antenna structure can be configured to achieve desired bands and bandwidths based on the CRLH properties. Some examples of MTM antenna structures are described in the U.S. patent applications: Ser. No. 11/741,674 entitled "Antennas, Devices and Systems Based on Metamaterial Structures," filed on Apr. 27, 2007; and Ser. No. 11/844,982 entitled "Antennas Based on Metamaterial Structures," filed on Aug. 24, 2007. The disclosures of the above US patent documents are incorporated herein by reference. Certain aspects of MTM antenna structures are described below.

An MTM antenna or MTM transmission line (TL) has an MTM structure with one or more MTM unit cells. The equivalent circuit for each MTM unit cell includes a right-handed series inductance (LR), a right-handed shunt capacitance (CR), a left-handed series capacitance (CL), and a left-handed shunt inductance (LL). LL and CL are structured and connected to provide the left-handed properties to the unit cell. This type of CRLH TLs or antennas can be implemented by using distributed circuit elements, lumped circuit elements or a combination of both. Each unit cell is smaller than ~$\lambda/4$ where $\lambda$ is the wavelength of the electromagnetic signal that is transmitted in the CRLH TL or antenna.

A pure LH metamaterial follows the left-hand rule for the vector trio (E,H,$\beta$), and the phase velocity direction is opposite to the signal energy propagation direction. Both the permittivity $\epsilon$ and permeability $\mu$ of the LH material are simultaneously negative. A CRLH metamaterial can exhibit both left-handed and right-handed electromagnetic properties depending on the regime or frequency of operation. The CRLH metamaterial can exhibit a non-zero group velocity when the wavevector (or propagation constant) of a signal is zero. In an unbalanced case, there is a bandgap in which electromagnetic wave propagation is forbidden. In a balanced case, the dispersion curve does not show any discontinuity at the transition point of the propagation constant $\beta(\omega_o)=0$ between the left- and right-handed regions, where the guided wavelength is infinite, i.e., $\lambda_g=2\pi/|\beta|\rightarrow\infty$, while the group velocity is positive:

$$v_g = \frac{d\omega}{d\beta}\bigg|_{\beta=0} > 0. \qquad \text{Eq. (1)}$$

This state corresponds to the zeroth order mode m=0 in a transmission line (TL) implementation. The CRLH structure supports a fine spectrum of resonant frequencies with the dispersion relation that extends to the negative $\beta$ region. This allows a physically small device to be built that is electrically large with unique capabilities in manipulating and controlling near-field around the antenna which in turn controls the far-field radiation patterns.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two metallization layers of a substrate where four conductive cell patches are formed in the top metallization layer of the substrate, and the other side of the substrate has the bottom metallization layer as the ground plane. Four centered conductive vias are formed to penetrate through the substrate to connect the four cell patches to the ground plane, respectively. The cell patch on the left side is electromagnetically coupled to a first feed line, and the cell patch on the right side is electromagnetically coupled to a second feed line. In some implementations, each cell patch is electromagnetically coupled to an adjacent cell patch without being directly in contact with the adjacent unit cell. This structure forms the MTM transmission line to receive an RF signal from the first feed line and to output the RF signal at the second feed line.

Figure 2:
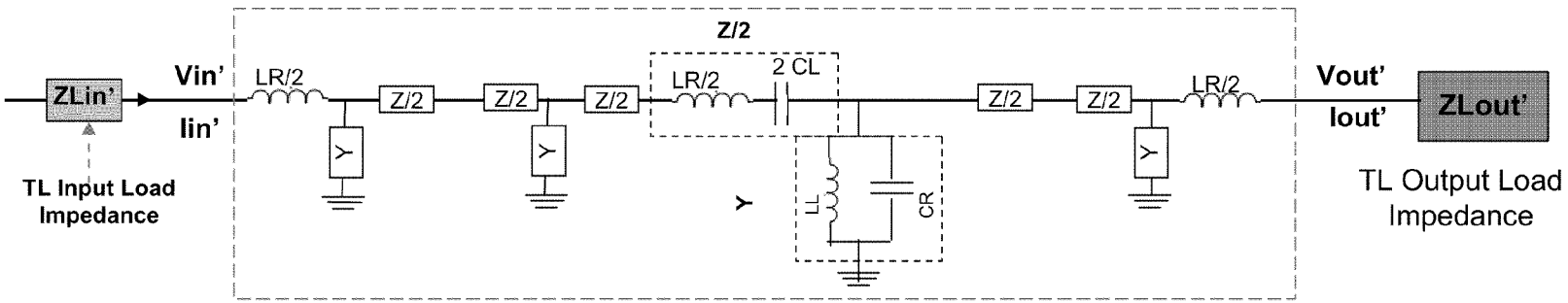
FIG. 2 shows an equivalent circuit of the 1D CRLH MTM TL shown in FIG. 1.

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. LR is due to the cell patch on the dielectric substrate, and CR is due to the dielectric substrate being sandwiched between the cell patch and the ground plane. CL is due to the presence of two adjacent cell patches coupled through a coupling gap, and the via induces LL.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of LL and CR. The relationships among these parameters are expressed as follows:

$$\omega_{SH} = \frac{1}{\sqrt{LLCR}};\ \omega_{SE} = \frac{1}{\sqrt{LRCL}}; \qquad \text{Eq. (2)}$$

$$\omega_R = \frac{1}{\sqrt{LRCR}};\ \omega_L = \frac{1}{\sqrt{LLCL}}$$

where, $$Z = j\omega LR + \frac{1}{j\omega CL} \text{ and } Y = j\omega CR + \frac{1}{j\omega LL}.$$

The two unit cells at the input/output edges in FIG. 1 do not include CL, since CL represents the capacitance between two adjacent cell patches and is missing at these input/output edges. The absence of the CL portion at the edge unit cells prevents $\omega_{SE}$ frequency from resonating. Therefore, only $\omega_{SH}$ appears as a zeroth order mode (m=0) resonance frequency.

Figure 3:
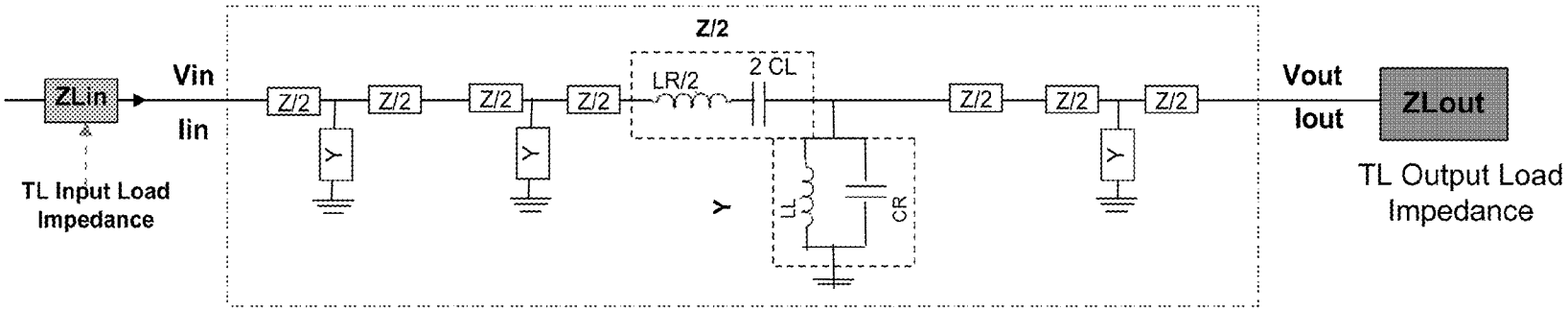
FIG. 3 shows another representation of the equivalent circuit of the 1D CRLH MTM TL shown in FIG. 1.

To simplify the computational analysis, a portion of the ZLin' and ZLout' series capacitor is included to compensate for the missing CL portion, and the remaining input and output load impedances are denoted as ZLin and ZLout, respectively, as seen in FIG. 3. Under this condition, all unit cells have identical parameters as represented by two series Z/2 blocks and one shunt Y block in FIG. 3, where the Z/2 block includes a series combination of LR/2 and 2CL, and the Y block includes a parallel combination of LL and CR.

Figure 4A:
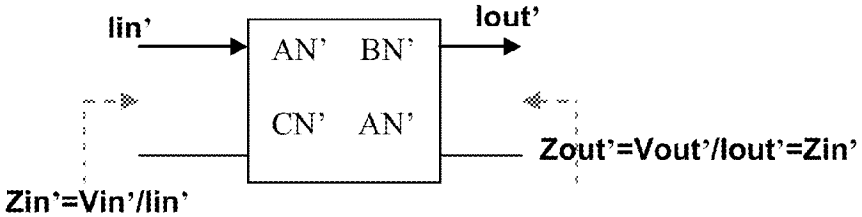
FIG. 4A shows a two-port network matrix representation for the 1D CRLH TL equivalent circuit shown in FIG. 2.
Figure 4B:
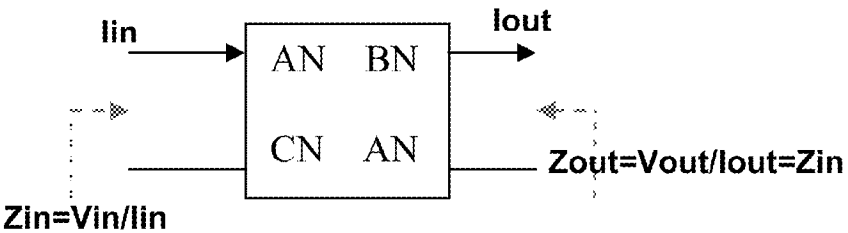
FIG. 4B shows another two-port network matrix representation for the 1D CRLH TL equivalent circuit shown in FIG. 3.
Figure 5:
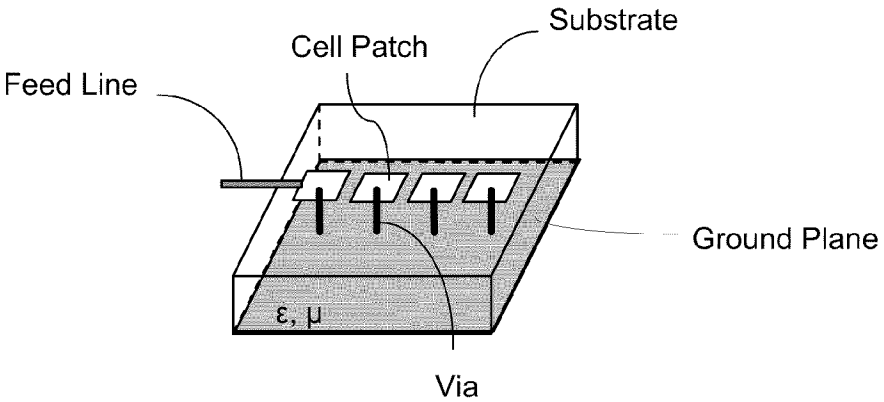
FIG. 5 shows an example of a 1D CRLH MTM antenna based on four unit cells.

FIG. 4A and FIG. 4B illustrate a two-port network matrix representation for the TL without the load impedances as shown in FIG. 2 and FIG. 3, respectively, FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to an antenna circuit and the unit cell on the right side is an open circuit so that the four cells interface with the air to transmit or receive an RF signal.

Figure 6B:
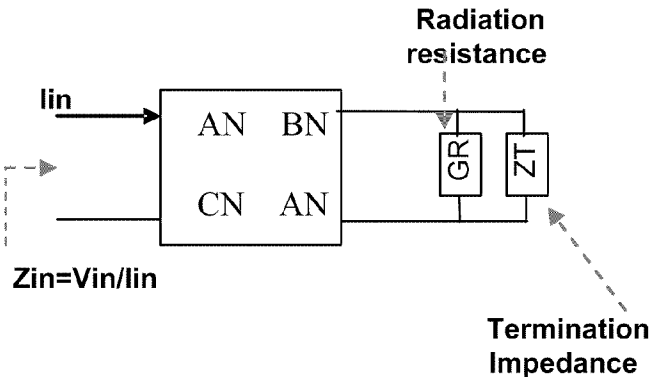
FIG. 6B shows another two-port network matrix representation for the 1D CRLH antenna equivalent circuit analogous to the TL case shown in FIG. 4B.
Figure 6A:
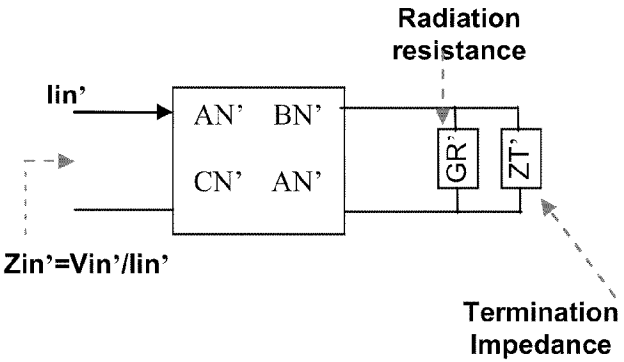
FIG. 6A shows a two-port network matrix representation for the 1D CRLH antenna equivalent circuit analogous to the TL case shown in FIG. 4A.

FIG. 6A shows a two-port network matrix representation for the antenna in FIG. 5. FIG. 6B shows a two-port network matrix representation for the antenna in FIG. 5 with the modification at the edges to account for the missing CL portion to have all the unit cells identical. FIGS. 6A and 6B are analogous to the matrix representations of the TL shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix}, \quad \text{Eq. (3)}$$

where AN=DN because the CRLH MTM TL in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional 2CL as expressed below:

$$ZLin' = ZLin + \frac{2}{j\omega CL}, \quad \text{Eq. (4)}$$

$$ZLout' = ZLout + \frac{2}{j\omega CL},$$

$$ZT' = ZT + \frac{2}{j\omega CL}.$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (2) are valid for the TL in FIG. 2 with the modified values AN', BN', and CN', which reflect the missing CL portion at the two edges.

The frequency bands can be determined from the dispersion equation derived by letting the N CRLH cell structure resonate with $n\pi$ propagation phase length, where n=0, ±1, ±2, . . . ±N. Here, each of the N CRLH cells is represented by Z and Y in Eq. (2), which is different from the structure shown in FIG. 2, where CL is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N), \ \Rightarrow |A_N| \le 1 \Rightarrow 0 \le \chi = -ZY \le 4 \forall N \\ \text{where } A_N = 1 \text{ at even resonances } |n| = 2m \in \left\{0, 2, 4, \ldots\ 2 \times \mathrm{Int}\left(\frac{N-1}{2}\right)\right\} \\ \text{and } A_N = -1 \text{ at odd resonances } |n| = 2m+1 \in \left\{1, 3, \ldots\ \left(2 \times \mathrm{Int}\left(\frac{N}{2}\right) - 1\right)\right\} \end{cases} \quad \text{Eq. (5)}$$

where Z and Y are given in Eq. (2), AN is derived from the linear cascade of N identical CRLH unit cells as in FIG. 3, and p is the cell size. Odd n=(2m+1) and even n=2m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of CL at the end cells, regardless of the number of cells. Higher-order frequencies are given by the following equations for the different values of $\chi$ specified in Table 1:

For $n > 0$, Eq. (6)

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 \chi\omega_R^2}{2}\right)^2 - \omega_{SH}^2\omega_{SE}^2}$$

Table 1 provides $\chi$ values for N=1, 2, 3, and 4. It should be noted that the higher-order resonances |n|>0 are the same regardless if the full CL is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as expressed in Eq. (5).

TABLE 1

Resonances for N = 1, 2, 3 and 4 cells

| | Modes | | | |
|---|---|---|---|---|
| N | \|n\| = 0 | \|n\| = 1 | \|n\| = 2 | \|n\| = 3 |
| N = 1 | $\chi_{(1.0)} = 0$; $\omega_0 = \omega_{SH}$ | | | |
| N = 2 | $\chi_{(2.0)} = 0$; $\omega_0 = \omega_{SH}$ | $\chi_{(2.1)} = 2$ | | |
| N = 3 | $\chi_{(3.0)} = 0$; $\omega_0 = \omega_{SH}$ | $\chi_{(3.1)} = 1$ | $\chi_{(3.2)} = 3$ | |
| N = 4 | $\chi_{(4.0)} = 0$; $\omega_0 = \omega_{SH}$ | $\chi_{(4.1)} = 2 - \sqrt{2}$ | $\chi_{(4.2)} = 2$ | |

Figure 7A:
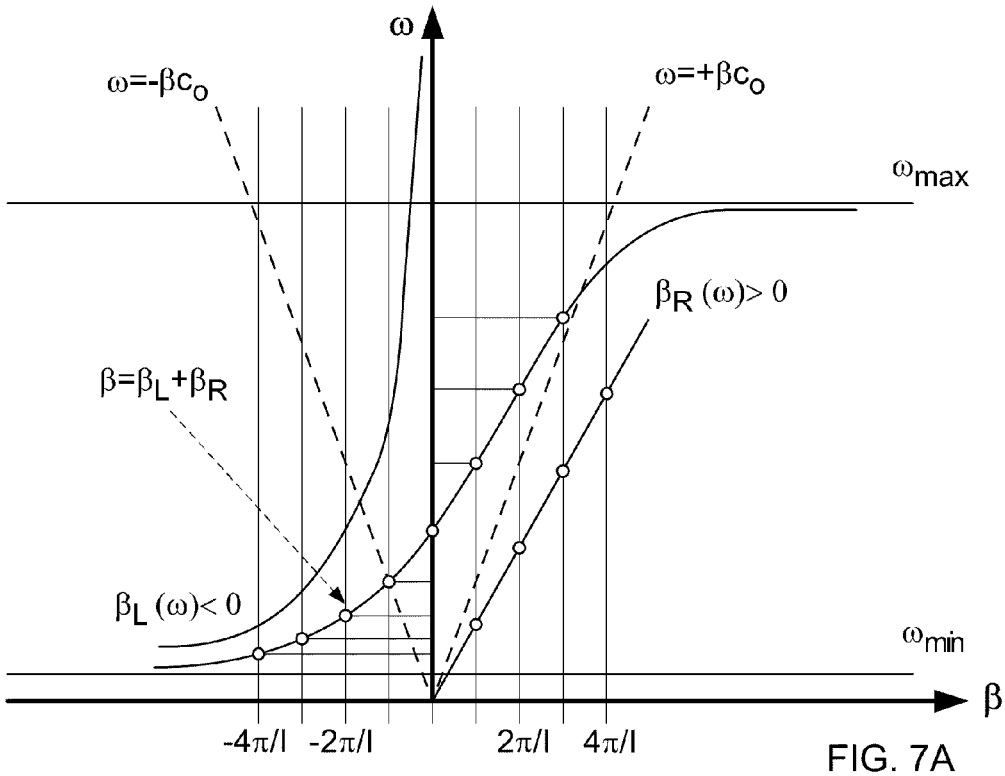
FIG. 7A shows an example of a dispersion curve for the balanced case.
Figure 7B:
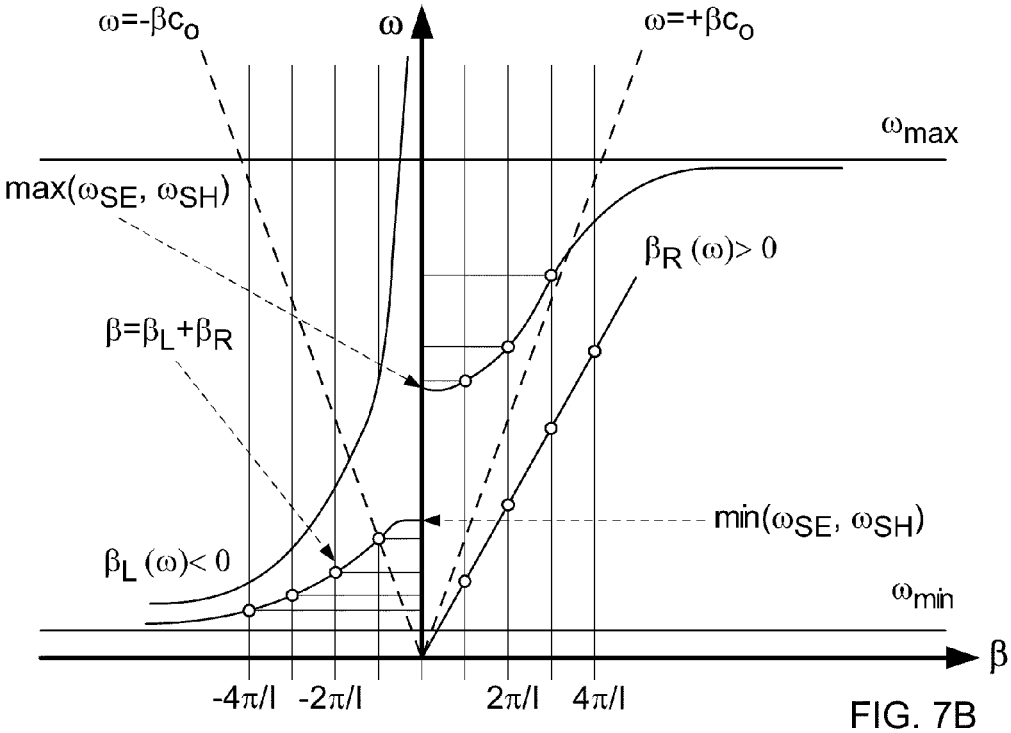
FIG. 7B shows an example of a dispersion curve for the unbalanced case.

The dispersion curve β as a function of frequency ω is illustrated in FIGS. 7A and 7B for the $\omega_{SE}=\omega_{SH}$ (balanced, i.e., LR CL=LL CR) and $\omega_{SE}\neq\omega_{SH}$ (unbalanced) cases, respectively. In the latter case, there is a frequency gap between $\min(\omega_{SE},\omega_{SH})$ and $\max(\omega_{SE},\omega_{SH})$. The limiting frequencies $\omega_{min}$ and $\omega_{max}$ values are given by the same resonance equations in Eq. (6) with $\chi$ reaching its upper bound $\chi=4$ as expressed in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \quad \text{Eq. (7)}$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}.$$

In addition, FIGS. 7A and 7B provide examples of the resonance position along the dispersion curves. In the RH region (n>0) the structure size l=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper.

Thus, the first condition to obtain broadbands, $1^{st}$ BB condition, can be expressed as follows:

$$COND1\text{: } 1^{st}BB \text{ condition } \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \quad \text{Eq. (8)}$$

$$\omega_{\pm1}, \omega_{\pm2} \ldots \Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p = \text{cell size and } \frac{d\chi}{d\omega}\Big|_{res} = \frac{2\omega_{\pm n}}{\omega_R^2}\left(1-\frac{\omega_{SE}^2\omega_{SH}^2}{\omega_{\pm n}^4}\right),$$

where $\chi$ is given in Eq. (5) and $\omega_R$ is defined in Eq. (2). The dispersion relation in Eq. (5) indicates that resonances occur when $|AN|=1$, which leads to a zero denominator in the $1^{st}$ BB condition (COND1) of Eq. (8). As a reminder, AN is the first transmission matrix entry of the N identical unit cells (FIG. 4B and FIG. 6B). The calculation shows that COND1 is indeed independent of N and given by the second equation in Eq. (8). It is the values of the numerator and $\chi$ at resonances, which are shown in Table 1, that define the slopes of the dispersion curves, and hence possible bandwidths. Targeted structures are at most $Np=\lambda/40$ in size with the bandwidth exceeding 4%. For structures with small cell sizes p, Eq. (8) indicates that high $\omega_R$ values satisfy COND1, i.e., low CR and LR values, since for $n<0$ resonances occur at $\chi$ values near 4 in Table 1, in other terms $(1-\chi/4\rightarrow0)$.

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1-\frac{\chi}{4}\right), \quad \text{Eq. (9)}$$

which has only positive real values. One reason that B1/C1 is greater than zero is due to the condition of $|AN|\leqq1$ in Eq. (5), which leads to the following impedance condition:

$$0\leqq -ZY=\chi\leqq4.$$

The $2^{nd}$ broadband (BB) condition is for Zin to slightly vary with frequency near resonances in order to maintain constant matching. Remember that the real input impedance Zin' includes a contribution from the CL series capacitance as expressed in Eq. (4). The $2^{nd}$ BB condition is given below:

$$COND2\text{: } 2^{ed}BB \text{ condition near resonances,} \quad \text{Eq. (10)}$$

$$\frac{dZin}{d\omega}\Big|_{near\ res} << 1.$$

Different from the transmission line example in FIG. 2 and FIG. 3, antenna designs have an open-ended side with infinite impedance which poorly matches the structure edge impedance. The capacitance termination is given by the equation below:

$$Z_T = \frac{AN}{CN}, \quad \text{Eq. (11)}$$

which depends on N and is purely imaginary. Since LH resonances are typically narrower than RH resonances, selected matching values are closer to the ones derived in the $n<0$ region than the $n>0$ region.

One method to increase the bandwidth of LH resonances is to reduce the shunt capacitor CR. This reduction can lead to higher $\omega_R$ values of steeper dispersion curves as explained in Eq. (8). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground outside the footprint of the cell patch. This truncated ground approach may be implemented in various configurations to achieve broadband resonances.

Figure 8:
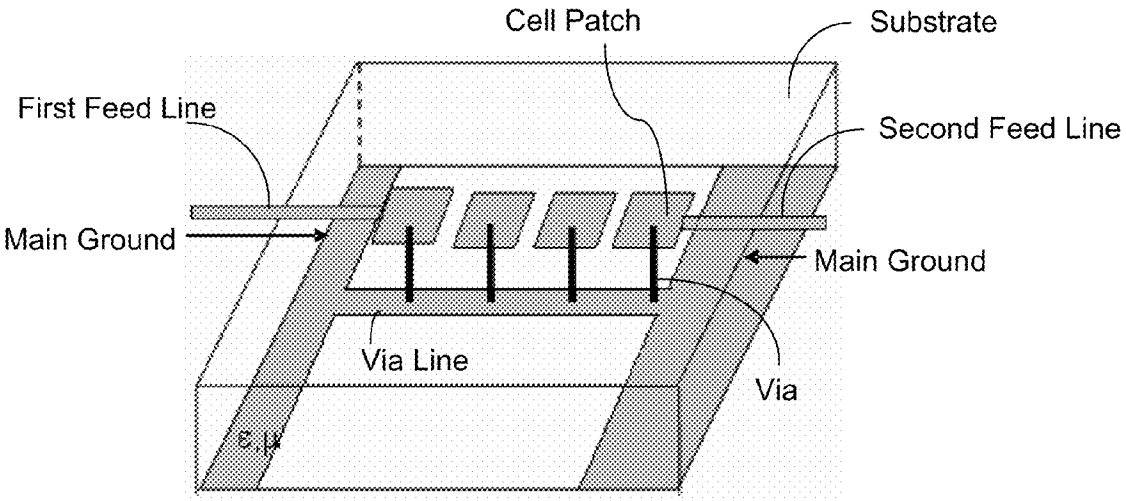
FIG. 8 shows an example of a 1D CRLH MTM TL with a truncated ground based on four unit cells.
Figure 9:
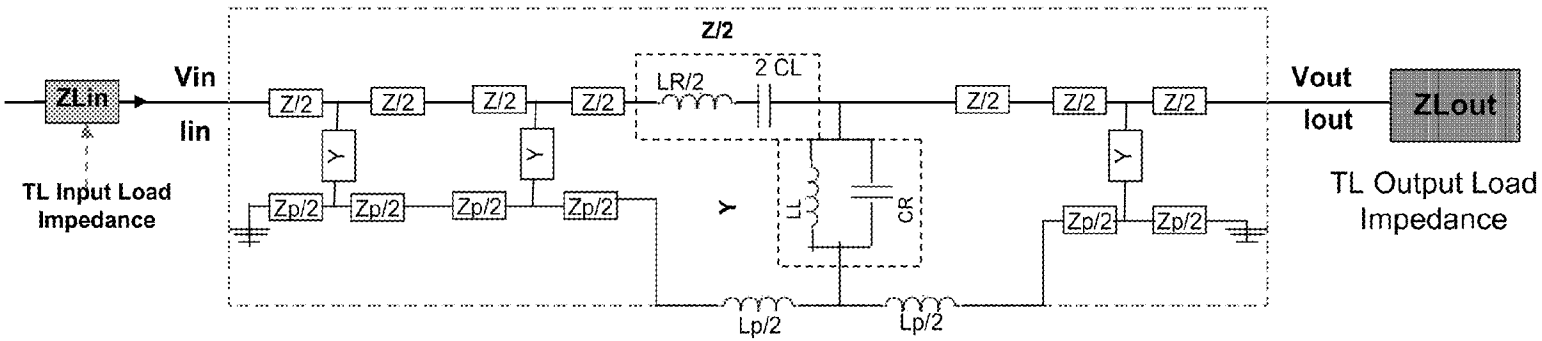
FIG. 9 shows an equivalent circuit of the 1D CRLH MTM TL with the truncated ground shown in FIG. 8.
Figure 10:
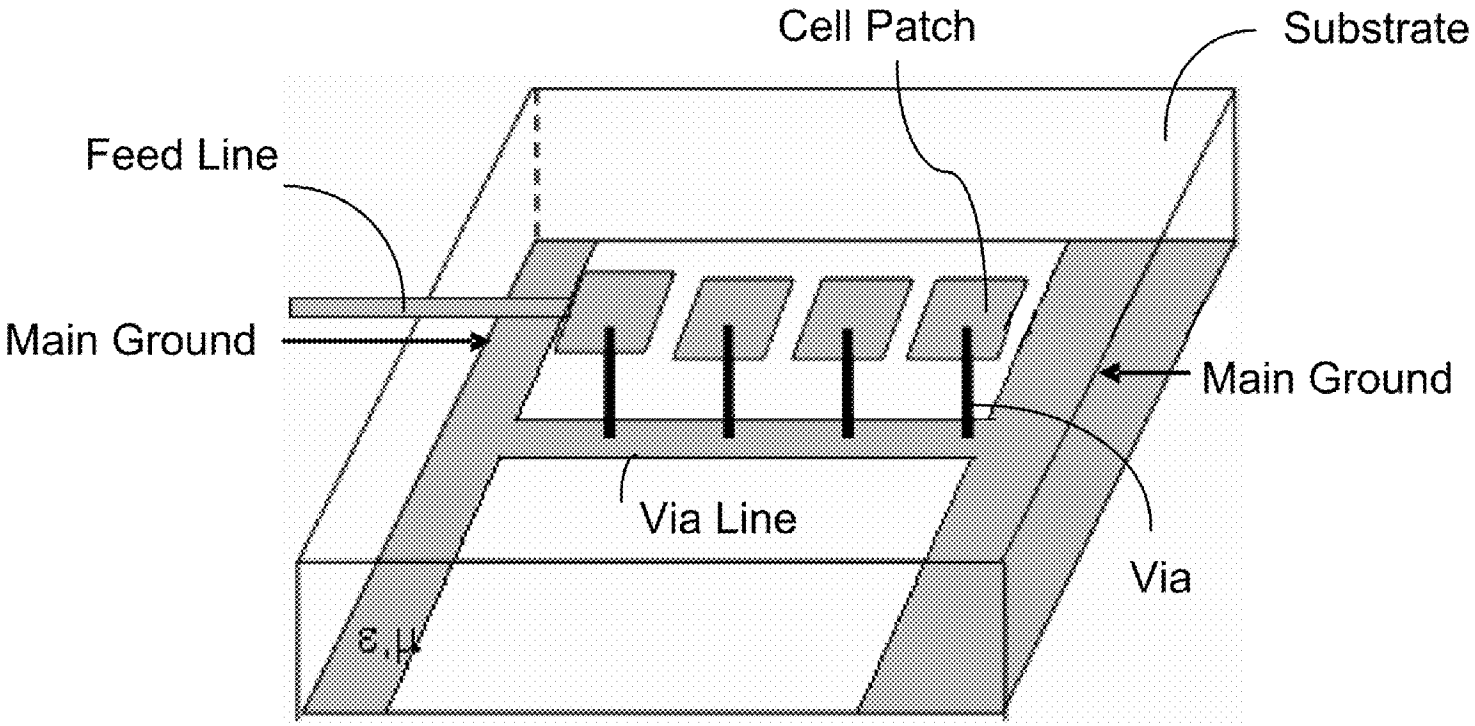
FIG. 10 shows an example of a 1D CRLH MTM antenna with a truncated ground based on four unit cells.

FIG. 8 illustrates one example of a truncated ground electrode for a four-cell MTM transmission line where the ground electrode has a dimension that is less than the cell patch along one direction underneath the cell patch. The bottom metallization layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
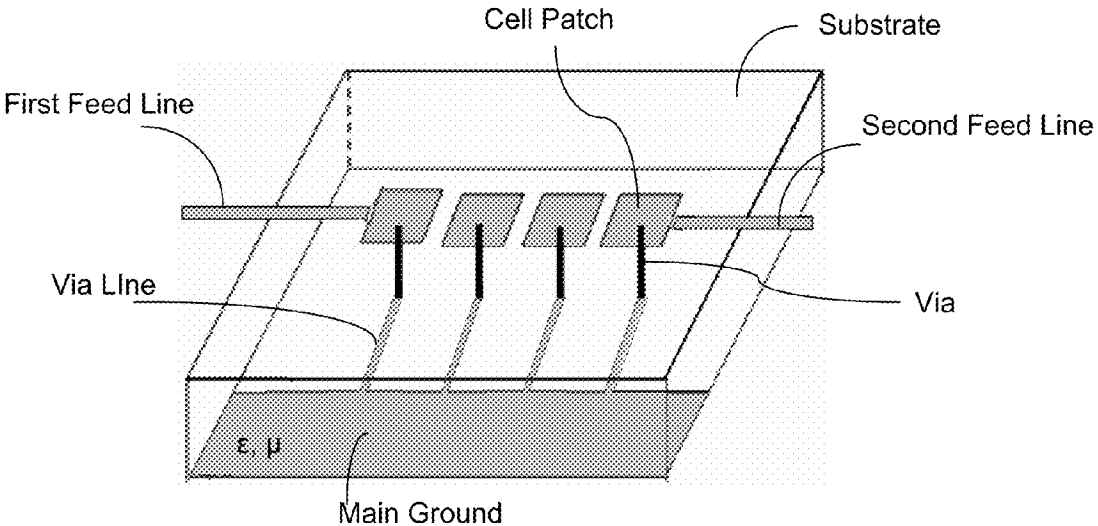
FIG. 11 shows another example of a 1D CRLH MTM TL with a truncated ground based on four unit cells.

FIG. 11 illustrates another example of an MTM antenna having a truncated ground. In this example, the bottom metallization layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance CR becomes small, and the resonances follow the same equations as in Eqs. (2), (6) and (7) and Table 1. Two approaches are presented below. FIGS. 8 and 9 represent the first approach, Approach 1, wherein the resonances are the same as in Eqs. (2), (6) and (7) and Table 1 after replacing LR by (LR+Lp). For $|n|\neq 0$, each mode has two resonances corresponding to (1) $\omega_{\pm n}$ for LR being replaced by (LR+Lp) and (2) $\omega_{\pm n}$ for LR being replaced by (LR+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad \text{Eq. (12)}$$

$$\text{where } \chi = -YZ \text{ and } \chi_P = -YZ_p,$$

where Zp=jωLp and Z, Y are defined in Eq. (2). The impedance equation in Eq. (12) provides that the two resonances ω and ω' have low and high impedances, respectively. Thus, it is easy to tune near the ω resonance in most cases.

Figure 12:
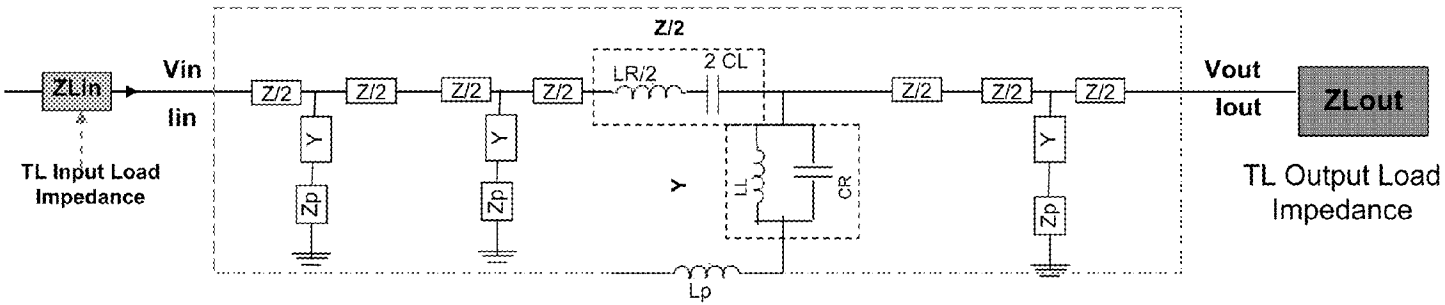
FIG. 12 shows an equivalent circuit of the 1D CRLH MTM TL with the truncated ground shown in FIG. 11.

The second approach, Approach 2, is illustrated in FIGS. 11 and 12 and the resonances are the same as in Eqs. (2), (6), and (7) and Table 1 after replacing LL by (LL+Lp). In the second approach, the combined shunt inductor (LL+Lp) increases while the shunt capacitor CR decreases, which leads to lower LH frequencies.

The above exemplary MTM structures are formed in two metallization layers, and one of the two metallization layers is used to include the ground electrode and is connected to the other metallization layer by conductive vias. Such two-layer CRLH MTM TLs and antennas with vias can be constructed with a full ground as shown in FIGS. 1 and 5 or a truncated ground as shown in FIGS. 8, 10 and 11.

One type of MTM antenna structures is a Single-Layer Metallization (SLM) MTM antenna structure, which has conductive parts of the MTM structure, including a ground, in a single metallization layer formed on one side of a substrate. A Two-Layer Metallization Via-Less (TLM-VL) MTM antenna structure is of another type characterized by two metallization layers on two parallel surfaces of a substrate without having a conductive via to connect one conductive part in one metallization layer to another conductive part in the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference as part of this specification.

The SLM and TLM-VL MTM structures simplify the two-layer-via design shown in FIGS. 8, 10 and 11 by either reducing the two-layer design into a single metallization layer design or by providing a two-layer design without the interconnecting vias. A SLM MTM structure, despite its simple structure, can be implemented to perform functions of a two-layer CRLH MTM structure with a via connected to a truncated ground. In a two-layer CRLH MTM structure with a via connecting the two metallization layers, the shunt capacitance CR is induced in the dielectric material between the cell patch in the top metallization layer and the ground in the bottom metallization layer, and the value of CR tends to be small with the truncated ground in comparison with a design that has a full ground.

In one implementation, a SLM MTM structure includes a substrate having a first substrate surface and an opposite substrate surface, a metallization layer formed on the first substrate surface and patterned to have two or more conductive parts to form the SLM MTM structure without a conductive via penetrating the dielectric substrate. The conductive parts in the metallization layer include a cell patch of the SLM MTM structure, a ground that is spatially separated from the cell patch, a via line that interconnects the ground and the cell patch, and a feed line that is electromagnetically coupled to the cell patch without being directly in contact with the cell patch. Therefore, there is no dielectric material vertically sandwiched between two conductive parts in this SLM MTM structure. As a result, the shunt capacitance CR of the SLM MTM structure is negligibly small with a proper design. A small shunt capacitance can still be induced between the cell patch and the ground, both of which are in the single metallization layer. The shunt inductance LL in the SLM MTM structure is negligible due to the absence of the via penetrating the substrate, but the inductance Lp can be relatively large due to the via line connected to the ground.

Different from the SLM and TLM-VL MTM antenna structures, a multilayer MTM antenna structure has conductive parts, including a ground, in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference as part of this specification. These multiple metallization layers are patterned to have multiple conductive parts based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures can have at least one conductive via to connect one conductive part in one metallization layer to another conductive part in another metallization layer.

An exemplary implementation of a double-layer metallization (DLM) MTM structure includes a substrate having a first substrate surface and a second substrate surface opposite to the first substrate surface, a first metallization layer formed on the first substrate surface, and a second metallization layer formed on the second substrate surface, where the two metallization layers are patterned to have two or more conductive parts with at least one conductive via connecting one conductive part in the first metallization layer to another conductive part in the second metallization layer. The conductive parts in the first metallization layer include a cell patch of the DLM MTM structure and a feed line that is electromagnetically coupled to the cell patch without being directly in contact with the cell patch. The conductive parts in the second metallization layer include a via line that interconnects a ground and the cell patch through a via formed in the substrate. An additional conductive line, such as a meander line, can be added to the feed line to induce a monopole resonance to obtain a broadband or multiband antenna operation.

The MTM antenna structures can be configured to support multiple frequency bands including a "low band" and a "high band." The low band includes at least one left-handed (LH) mode resonance and the high band includes at least one right-handed (RH) mode resonance. These MTM antenna structures can be implemented to use a LH mode to excite and better match the low frequency resonances as well as to improve impedance matching at high frequency resonances. Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz)

which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands. A quad-band antenna can be used to cover one of the CDMA and GSM bands in the cellular band (low band) and all three bands in the PCS/DCS band (high band). A penta-band antenna can be used to cover all five bands with two in the cellular band (low band) and three in the PCS/DCS band (high band). Note that the WWAN band refers to these five bands ranging from 824 MHz to 2170 MHz when applied for laptop wireless communications. Examples of frequency bands for WiFi applications include two bands: one ranging from 2.4 to 2.48 GHz (low band), and the other ranging from 5.15 GHz to 5.835 GHz (high band). The frequency bands for WiMax applications involve three bands: 2.3-2.4 GHZ, 2.5-2.7 GHZ, and 3.5-3.8 GHz. An exemplary frequency band for Long Term Evolution (LTE) applications includes the range of 746-796 MHz. An exemplary frequency band for GPS applications includes 1.575 GHz.

A MTM structure can be specifically tailored to comply with requirements of an application, such as PCB real-estate factors, device performance requirements and other specifications. The cell patch in the MTM structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. A launch pad can be added at the distal end of the feed line to enhance coupling. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, spiral, meander, or combinations of different shapes. The additional conductive line can be placed in the top, mid or bottom layer, or a few millimeters above the substrate.

A conventional dipole antenna, for example, has a size of about one half of one wavelength for the RF signal at an antenna resonant frequency and thus requires a relatively large real estate for RF frequencies used in various wireless communication systems. MTM antennas can be structured to have a compact and small size while providing the capability to support multiple frequency bands. The physical size or the footprint of the MTM antenna at a particular surface can be further reduced by forming the MTM antenna in a non-planar configuration.

The MTM antenna designs described in this document provide antennas for wireless communications based on metamaterial (MTM) structures which arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device. For example, one or more antenna sections of the MTM antenna can be located on a dielectric substrate while placing one or more other antenna sections of the MTM antenna on another dielectric substrate so that the antenna sections of the MTM antenna are spatially distributed in a non-planar configuration such as an L-shaped antenna configuration. In various applications, antenna portions of an MTM antenna can be arranged to accommodate various parts in parallel or non-parallel layers in a three-dimensional (3D) substrate structure. Such non-planar MTM antenna structures may be wrapped inside or around a product enclosure. The antenna sections in a non-planar MTM antenna structure can be arranged to engage to an enclosure, housing walls, an antenna carrier, or other packaging structures to save space. In some implementations, at least one antenna section of the non-planar MTM antenna structure is placed substantially parallel with and in proximity to a nearby surface of such a packaging structure, where the antenna section can be inside or outside of the packaging structure. In some other implementations, the MTM antenna structure can be made conformal to the internal wall of a housing of a product, the outer surface of an antenna carrier or the contour of a device package. Such non-planar MTM antenna structures can have a smaller footprint than that of a similar MTM antenna in a planar configuration and thus can be fit into a limited space available in a portable communication device such as a cellular phone. In some non-planar MTM antenna designs, a swivel mechanism or a sliding mechanism can be incorporated so that a portion or the whole of the MTM antenna can be folded or slid in to save space while unused. Additionally, stacked substrates may be used with or without a dielectric spacer to support different antenna sections of the MTM antenna and incorporate a mechanical and electrical contact between the stacked substrates to utilize the space above the main board.

Exemplary implementations of these and other non-planar MTM antenna structures are described below.

One design of an antenna device based on such a non-planar MTM antenna structure includes a device housing comprising walls forming an enclosure in which at least part of an MTM antenna and the communication circuit for the MTM antenna are located. The MTM antenna includes a first antenna part located inside the device housing and positioned closer to a first wall than other walls, and a second antenna part. The first antenna part includes one or more first antenna components electromagnetically coupled and arranged in a first plane substantially parallel to the first wall. The second antenna part includes one or more second antenna components electromagnetically coupled and arranged in a second plane different from the first plane. A joint antenna part connects the first and second antenna parts so that the one or more first antenna components of the first antenna part and the one or more second antenna components of the second antenna part are electromagnetically coupled to form the MTM antenna which supports at least one resonance frequency in an antenna signal. This MTM antenna with the first and second antenna parts can have a dimension less than one half of one wavelength of the resonance frequency. The first and second antenna parts can form a composite right and left handed (CRLH) MTM antenna.

Figure 13B:
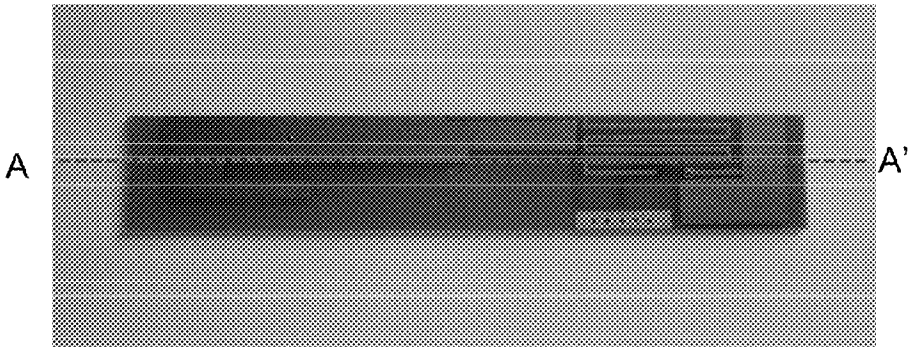
FIGS. 13B and 13C show photos of the top and bottom layers, respectively, of the planar version of the L-shaped antenna.
Figure 13C:
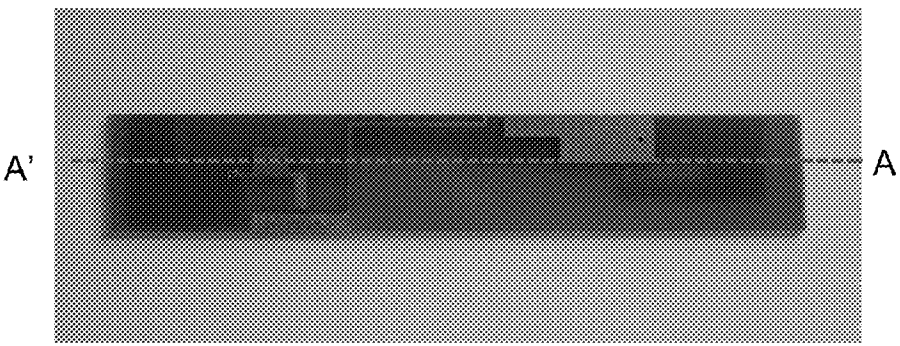
Figure 13A:
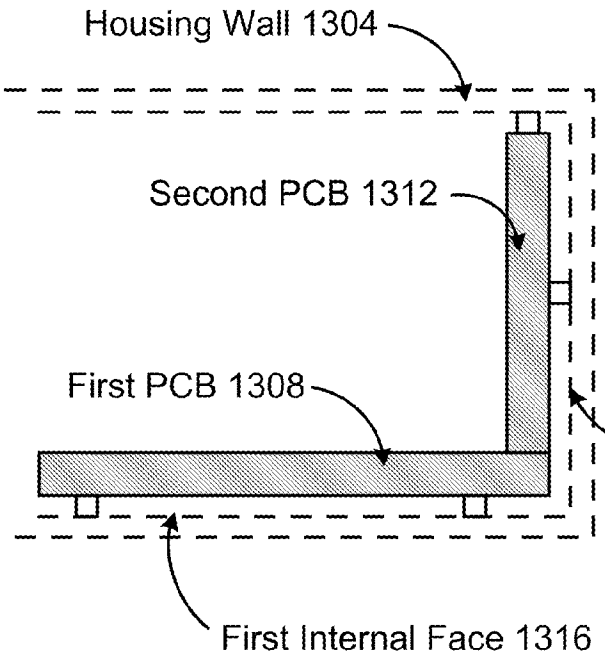
FIG. 13A shows the side view of an example of an L-shaped MTM antenna.

FIG. 13A shows the side view of an example of an L-shaped MTM antenna designed for penta-band WWAN applications covering the frequency range of 824-2170 MHz. This wireless device has an enclosure, i.e., the housing wall 1304, for accommodating the antenna and other components. FIGS. 13B and 13C show photos of the top and bottom layers, respectively, of the planar version of the L-shaped MTM antenna. The dashed line A-A' in FIGS. 13B and 13C represents the line where the PCB having the planar M™ antenna may be cut into two pieces, i.e., the first PCB 1308 and the second PCB 1312, which are then assembled into the L-shape. Alternatively, these two separate PCBs 1308 and 1312 may be individually pre-fabricated and then assembled. Thus, the L-shaped MTM antenna in FIG. 13A is constructed by attaching one edge along the line A-A' of the first PCB 1308 to one edge along the line A-A' of the second PCB 1312 to form a substantially right-angled corner in FIG. 13A. Depending on the given form of the housing wall 1304, the angle formed by the corner of the L shape can be acute or obtuse. The first PCB 1308 is in parallel with and in proximity to the first internal face 1316 of the housing wall 1304, and the second PCB 1312 is in parallel with and in proximity to the second internal face 1320 of the housing wall 1304. Therefore, this structure saves the space in one dimension by utilizing another space in another dimension, which is otherwise unused, by placing the second PCB 1312 along the second internal face 1320 of the housing wall 1304.

The position of the line A-A' may be chosen primarily based on available space inside the device housing. Manufacturability considerations should also play a role in determining the position of the line A-A'. For example, it is preferable to have a minimum number of electrical contacts at the corner upon assembling the two PCBs. In addition, it should be taken into consideration that the antenna performance can be influenced by the relative distance of the antenna to the main ground. Thus, positioning of the main conductive parts such as a cell patch of the MTM antenna also plays a role in determining the position of the line A-A'. The two PCBs 1308 and 1312 can be attached by solder, adhesive, heat-stick, spring contact or other suitable method. Similarly, the resultant non-planar structure can be attached to the inside of the housing wall by solder, adhesive, heat-stick, or other suitable method as schematically indicated by open rectangles in FIG. 13A or may be kept loose depending on the application.

In this and other non-planar MTM structures, the split of antenna components of the MTM antenna between the first PCB 1308 and the second PCB 1312 is designed based on various considerations, such as the number of contacts between the PCB 1308 and the PCB 1312, the physical layout and dimension of the antenna components on the PCB 1308 and the PCB 1312 and operating parameters of the antenna.

As a specific example, the MTM antenna design in FIGS. 13A-13C can be structured to support five frequency bands for WWAN laptop applications within the tight space. A feed line has a bottom branch in the bottom layer and a top branch in the top layer, which are connected by a first via formed in the substrate. A meander line is attached to the top branch of the feed line to induce a monopole mode. The feed line is electromagnetically coupled, through a coupling gap, to a cell patch formed in the top layer. A via line is formed in the bottom layer and is connected to a bottom ground. The cell patch is connected to the via line through a second via penetrating the substrate and hence to the bottom ground. Each of the top and bottom branches of the feed line, cell patch and via line has a polygonal shape for matching purposes. Modifications to the planar MTM antenna design may be made for optimizing the space usage and antenna performance. For example, the feed line may be elongated to accommodate the entire cell patch in the second PCB 1312, which is above the line A-A' in FIG. 13B.

Figure 14A:
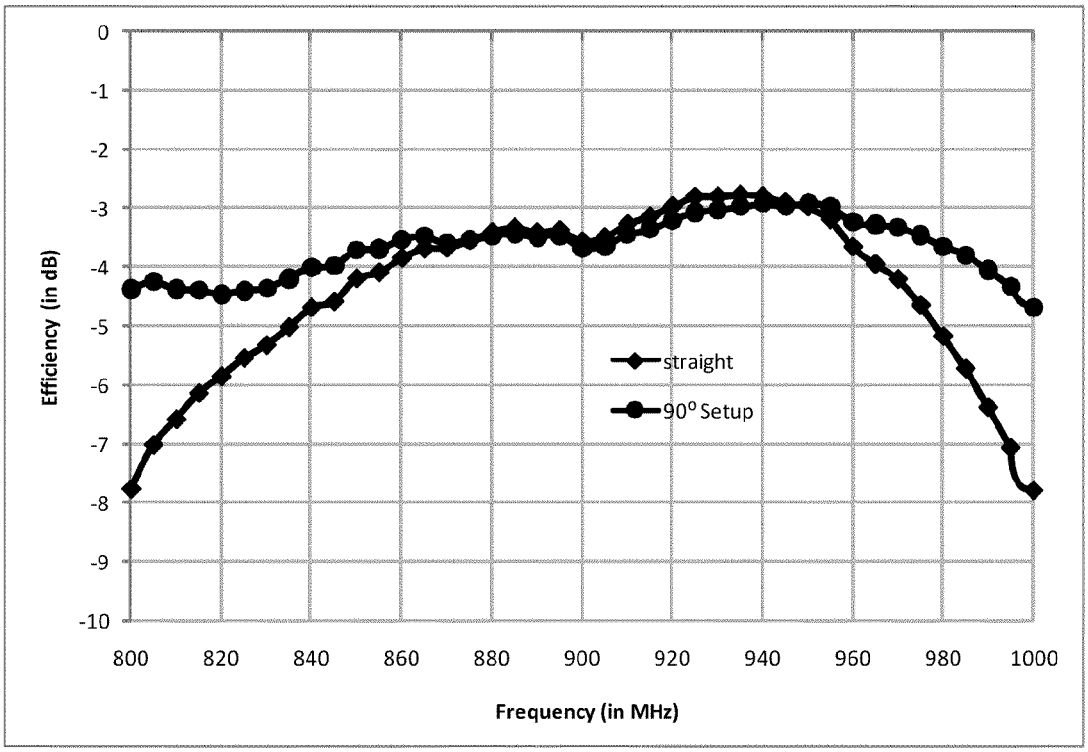
FIGS. 14A and 14B show the measured efficiency results of the L-shaped MTM antenna shown in FIGS. 13A-13C, for the high band and low band, respectively, for the cases of straight setup (solid line with diamonds) and 90° setup (solid line with circles).
Figure 14B:
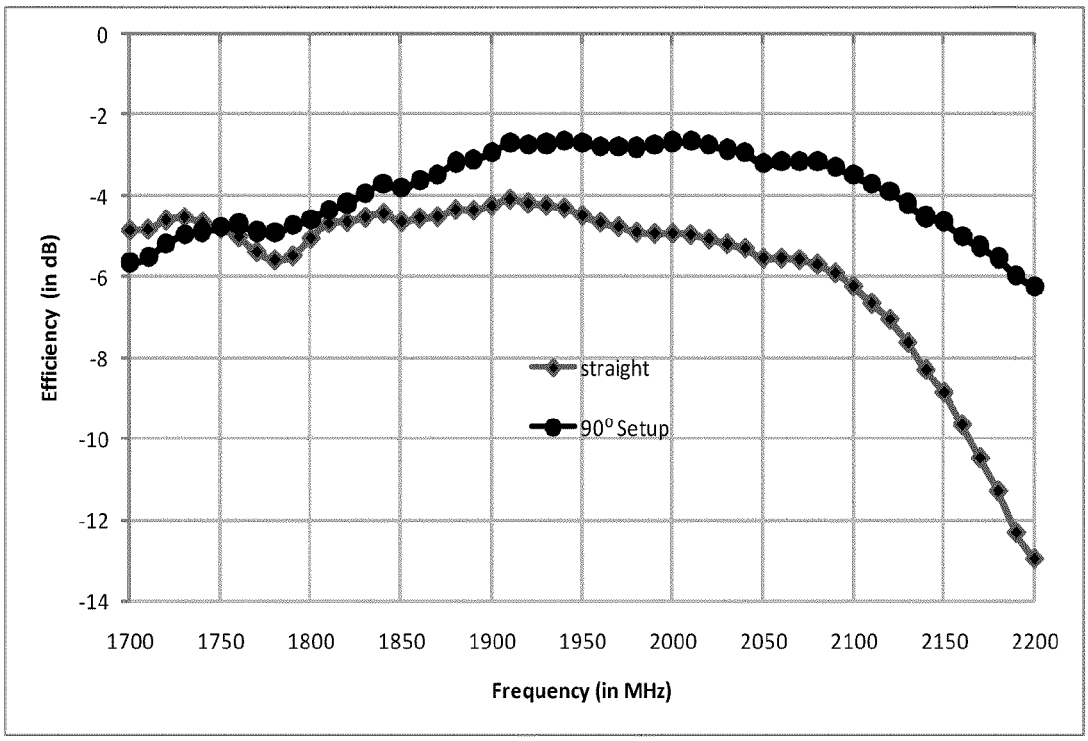

FIGS. 14A and 14B show the measured efficiency results of the penta-band MTM antenna for WWAN applications, which is the L-shaped MTM antenna shown in FIGS. 13A-13C. The efficiency plots for the high band and the low band are displayed separately for the cases of straight setup (planar configuration as in FIGS. 13B and 13C, indicated by solid line with diamonds) and 90° setup (non-planar L-shape configuration as in FIG. 13A, indicated by solid line with circles). It can be seen that the efficiency of the 90° setup is comparable or better than that of the straight setup over the penta-band WWAN frequency range.

FIGS. 15A and 15B show photos of the 3D view and side view, respectively, of an exemplary T-shaped MTM antenna 1504. This T-shaped non-planar form is devised to fit in a cell phone enclosure. This antenna is a SLM MTM antenna designed for penta-band cell phone applications covering the frequency range of 824-2170 MHz. FIG. 15C shows a photo of the top layer of the vertical section, i.e., the second PCB 1512, of the T-shaped MTM antenna 1504. The main board is indicated as a first PCB 1508. The line denoted by B-B' in FIG. 15C indicates the line where the first PCB 1508 is attached to form the T shape. The section above the line B-B' corresponds to the section above the first PCB 1508 in FIG. 15B, and the section below the line B-B' corresponds to the section below the first PCB 1508 in FIG. 15B. Depending on the given form of the cell phone enclosure, the angle formed by the two PCB pieces does not have to be a right angle, but can be acute or obtuse. The first PCB 1508 is positioned in parallel with and in proximity to the first internal face of the cell phone enclosure, and the second PCB 1512 is positioned in parallel with and in proximity to the second internal face of the cell phone enclosure.

Most of the antenna elements reside on the second PCB 1512. The first PCB 1508 includes two conductive traces, which are a first segment of the feed line connecting a feed port in the bottom layer of the first PCB 1508 to a second segment of the feed line formed in the top layer of the second PCB 1512, and a first segment of the via line connecting the ground in the top layer of the first PCB 1508 to a second segment of the via line formed in the top layer of the second PCB 1512. A meander line is attached to the second segment of the feed line in the top layer of the second PCB 1512, where the feed line is electromagnetically coupled to a cell patch through a coupling gap. The cell patch is connected to the second segment of the via line, hence to the ground.

Figure 16:
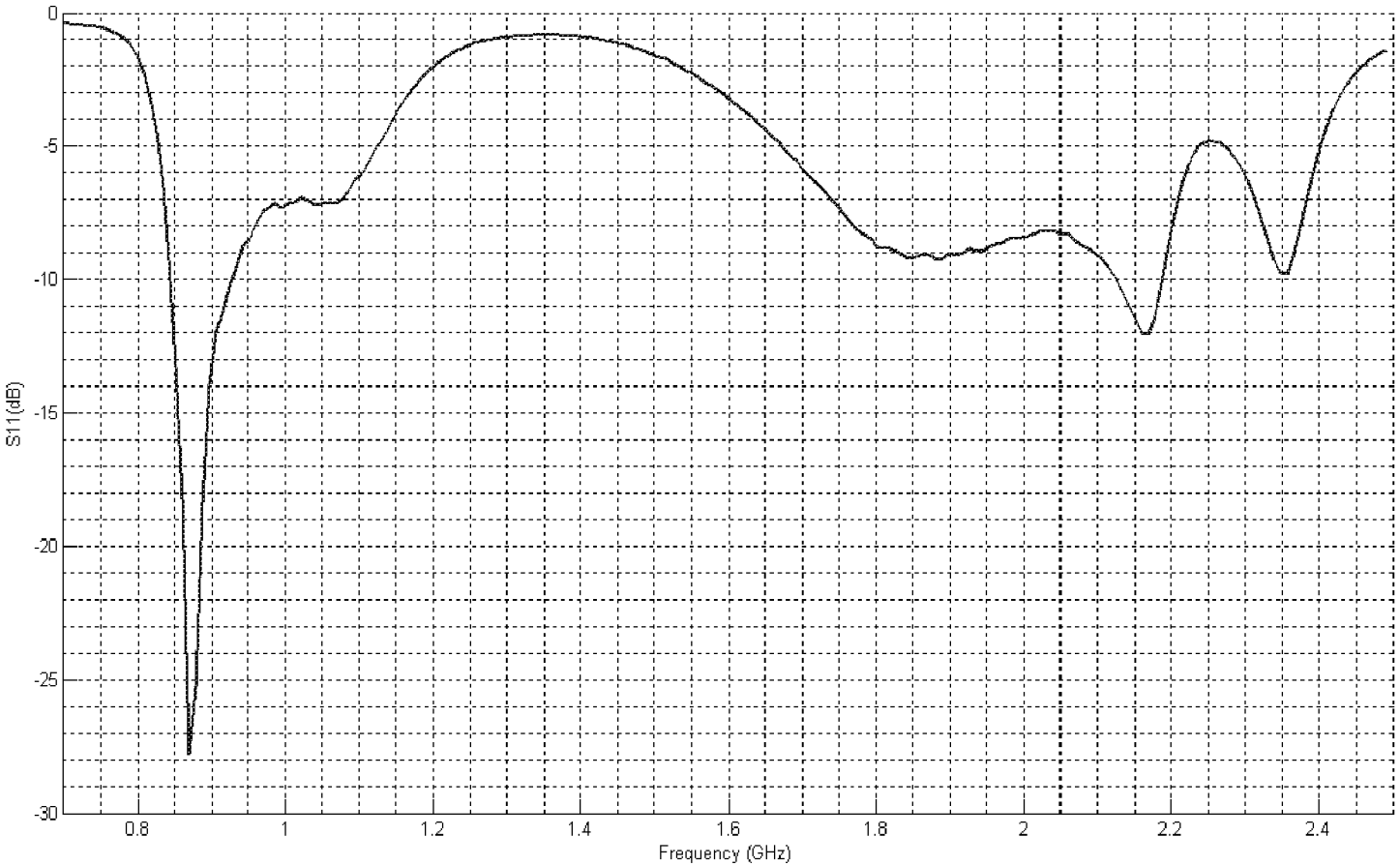
FIG. 16 shows the measured return loss of the T-shaped MTM antenna.

FIG. 16 shows the measured return loss of the T-shaped MTM antenna. Good matching is obtained for the low band as well as the high band.

Figure 17A:
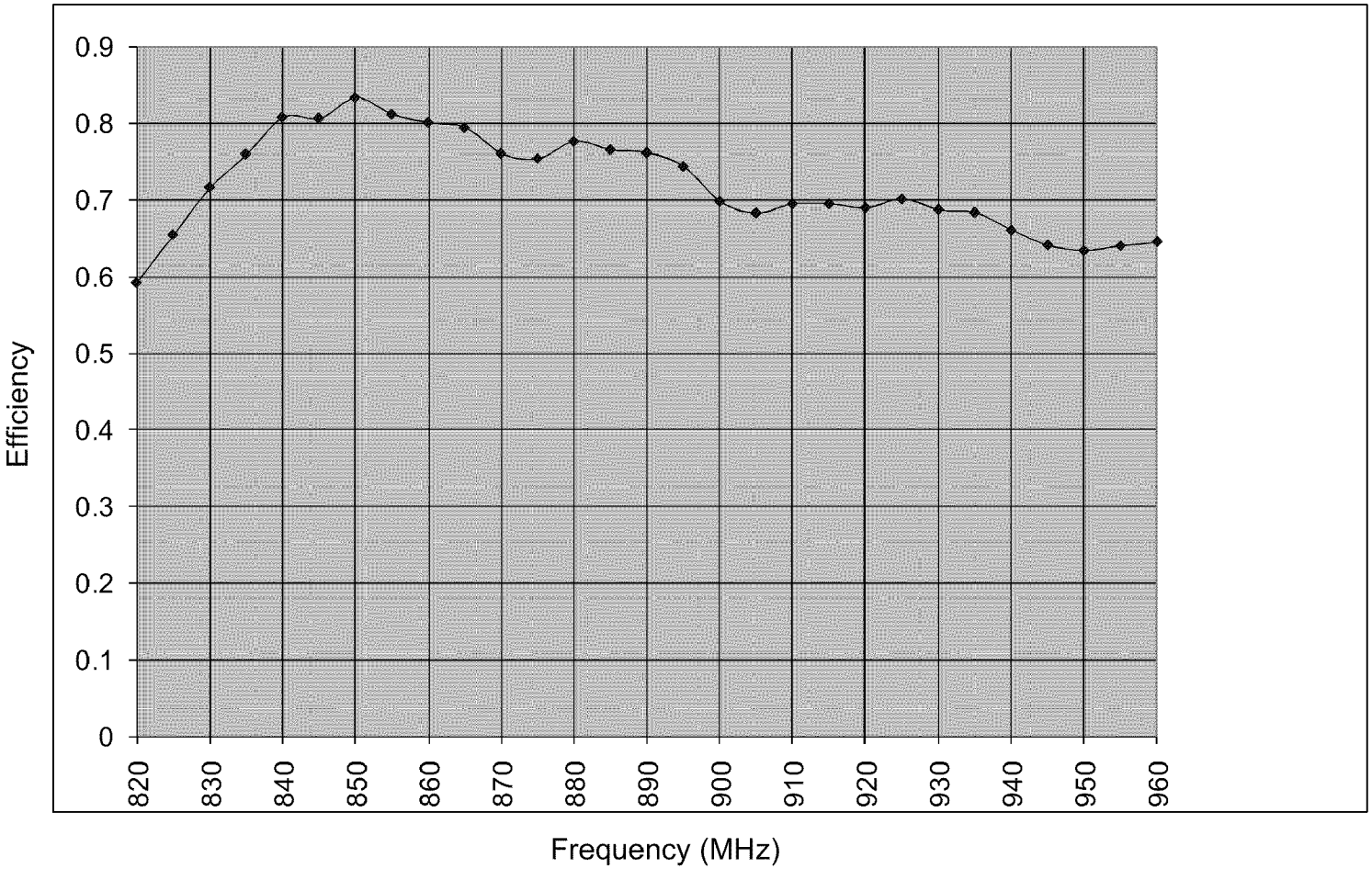
FIGS. 17A and 17B show the measured efficiency for the low band and high band, respectively, of the T-shaped MTM antenna.
Figure 17B:
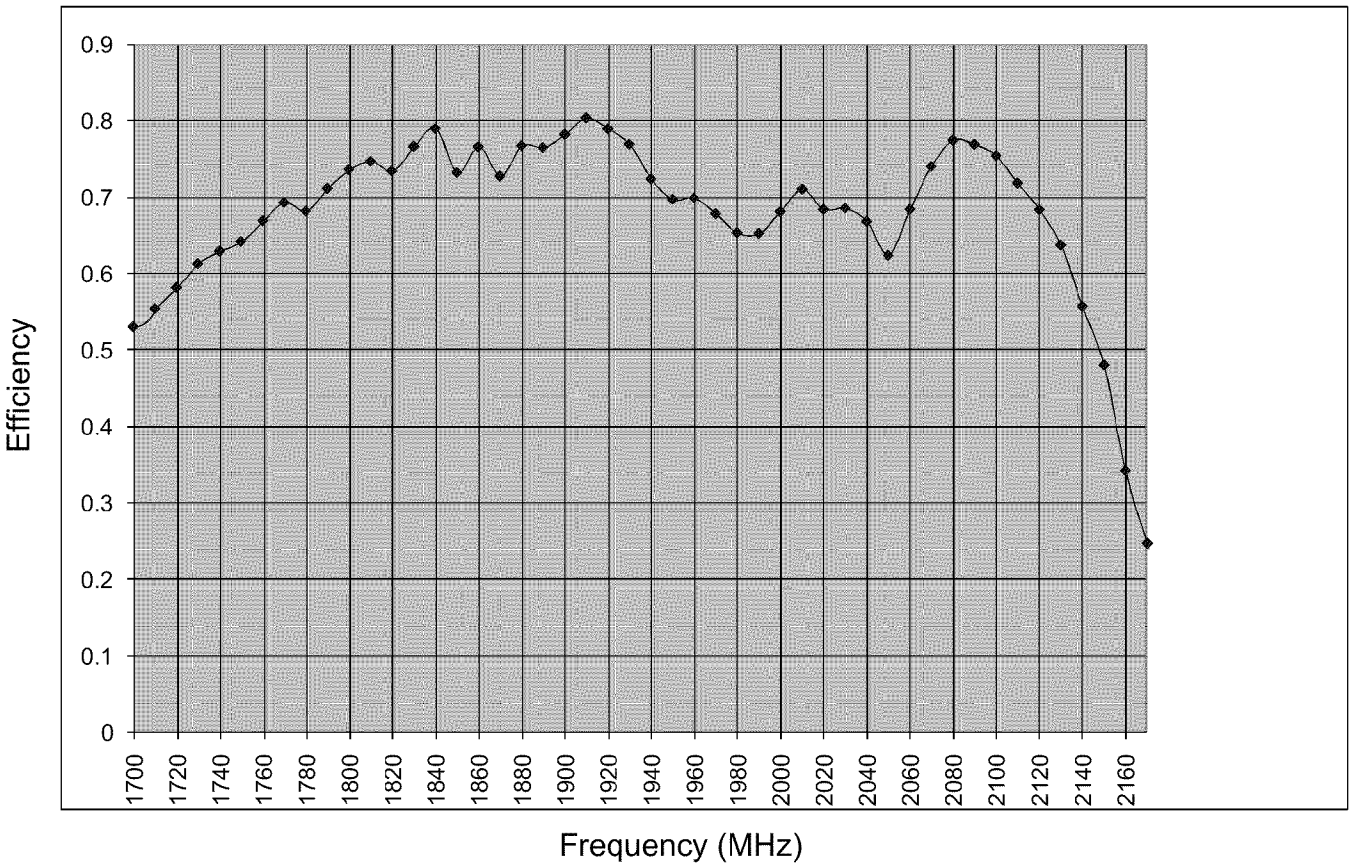

FIGS. 17A and 17B show the measured efficiency for the low band and the high band, respectively, of the T-shaped MTM antenna. Good efficiency is achieved in both bands.

Figure 18B:
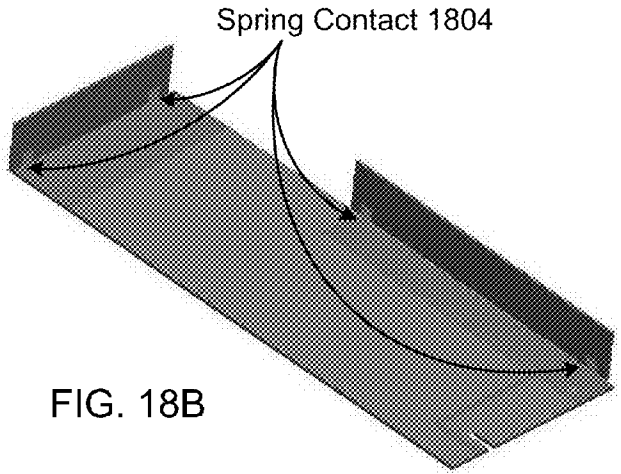
FIGS. 18A-18C show the implementation of spring contacts for attaching two PCBs.
Figure 18C:
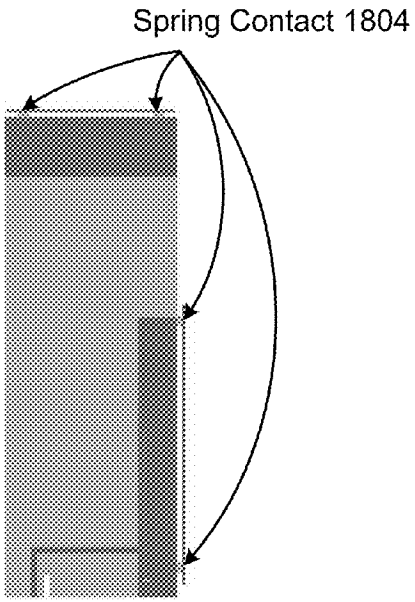
Figure 18A:
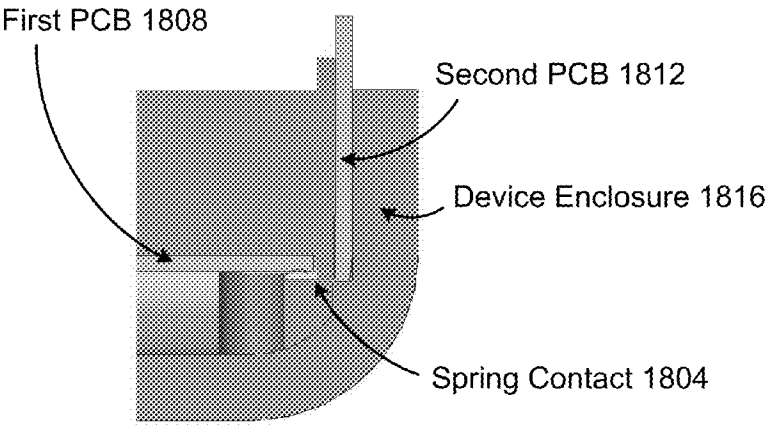

FIG. 18A-18C show an implementation of spring contacts for attaching two PCBs for an MTM antenna. FIG. 18A shows the side view of the spring contacts 1804 between the first PCB 1808 and the second PCB 1812, all of which are encapsulated with the device enclosure 1816. FIGS. 18B and 18C show the 3D view and top view of the antenna device without the device enclosure 1816, having two vertical PCBs (second PCBs 1812) attached with the spring contacts 1804. The device enclosure 1816 can be made of a suitable casing material such as a plastic. The spring contacts provide elasticity and mechanical resilience during assembly at the corner where two PCBs are attached.

Figure 19:
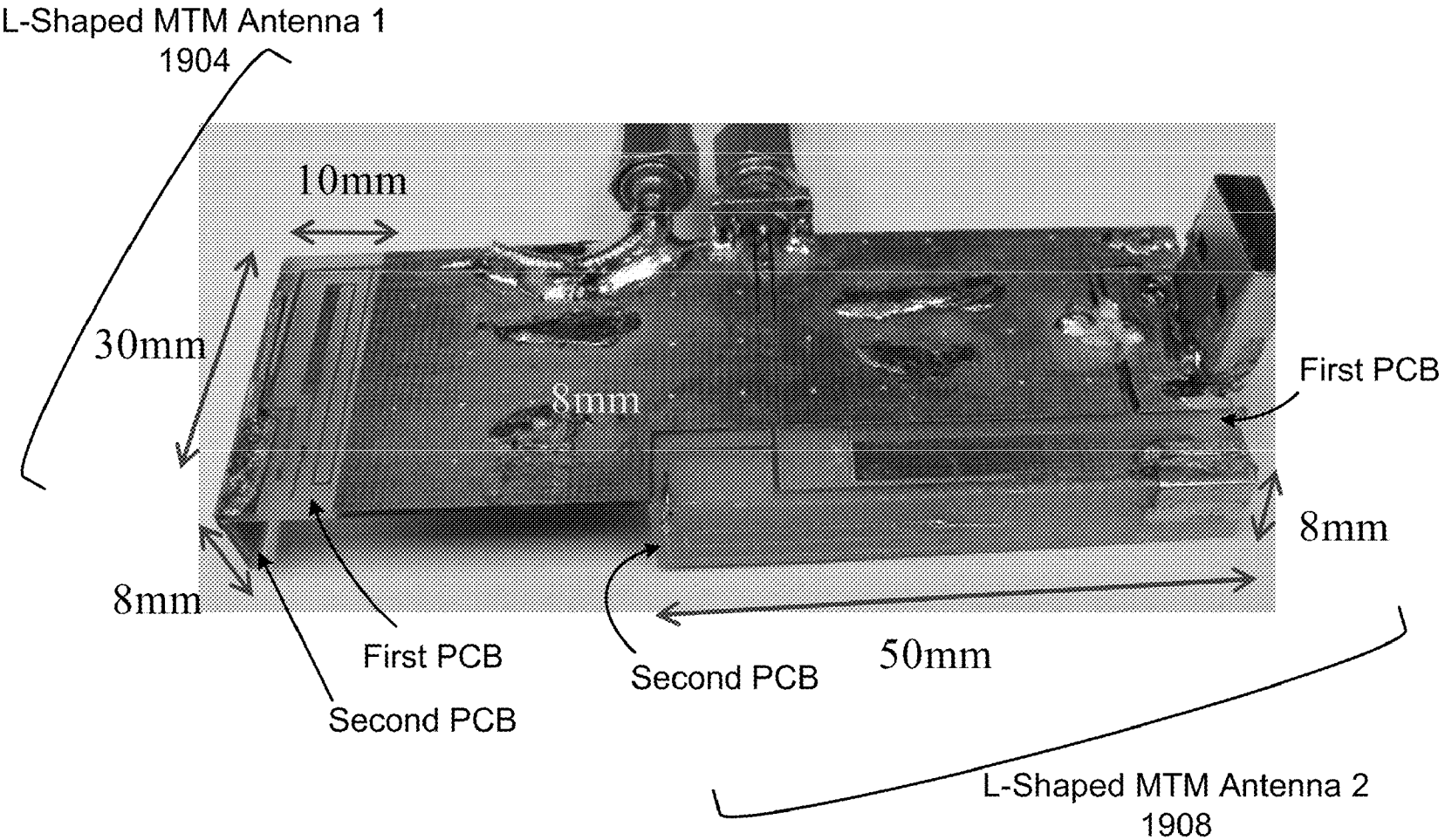
FIG. 19 shows a photo of an antenna device having two L-shaped MTM antennas.

FIG. 19 shows a photo of an antenna device having two L-shaped MTM antennas. For each antenna, the second PCB is attached vertical to the main board by using spring contacts. In this exemplary two-antenna implementation, the L-shaped MTM antenna 1 1904 has a dimension of 10 mm×30 mm×8 mm and operates as a transmitter, and the L-shaped MTM antenna 2 1908 has a dimension of 8 mm×50 mm×8 mm and operates as a receiver. These two MTM antennas are designed to support the LTE band (746-796 MHz), CDMA band (824-894 MHz) and PCS band (1850-1990 MHz) for USB dongle applications. Each of the two antennas has a cell patch that is polygonal in shape and extends from the first PCB (main PCB) to the second PCB (vertical PCB). For each antenna, a feed line is formed on the first PCB, and is electromagnetically coupled to the cell patch through a coupling gap. A meander line is added to the feed line in each of the two antennas to induce a monopole mode. For the L-shaped MTM antenna 1 1904, the meander line is formed on the first PCB. For the L-shaped MTM antenna 2 1908, the meander line extends from the first PCB to the second PCB. For each of the two antennas, a via line is formed in the bottom layer of the first PCB and is connected to the ground, and a via is formed in the substrate and connects the cell patch in the top layer to the via line in the bottom layer, hence to the ground. The widths of the feed line, via line and meander line are 0.5 mm, 0.3 mm and 0.3 mm, respectively, for the L-shaped MTM antenna 1 1904. The widths of the feed line, via line and meander line are all 0.5 mm for the L-shaped MTM antenna 2 1908.

Figure 20:
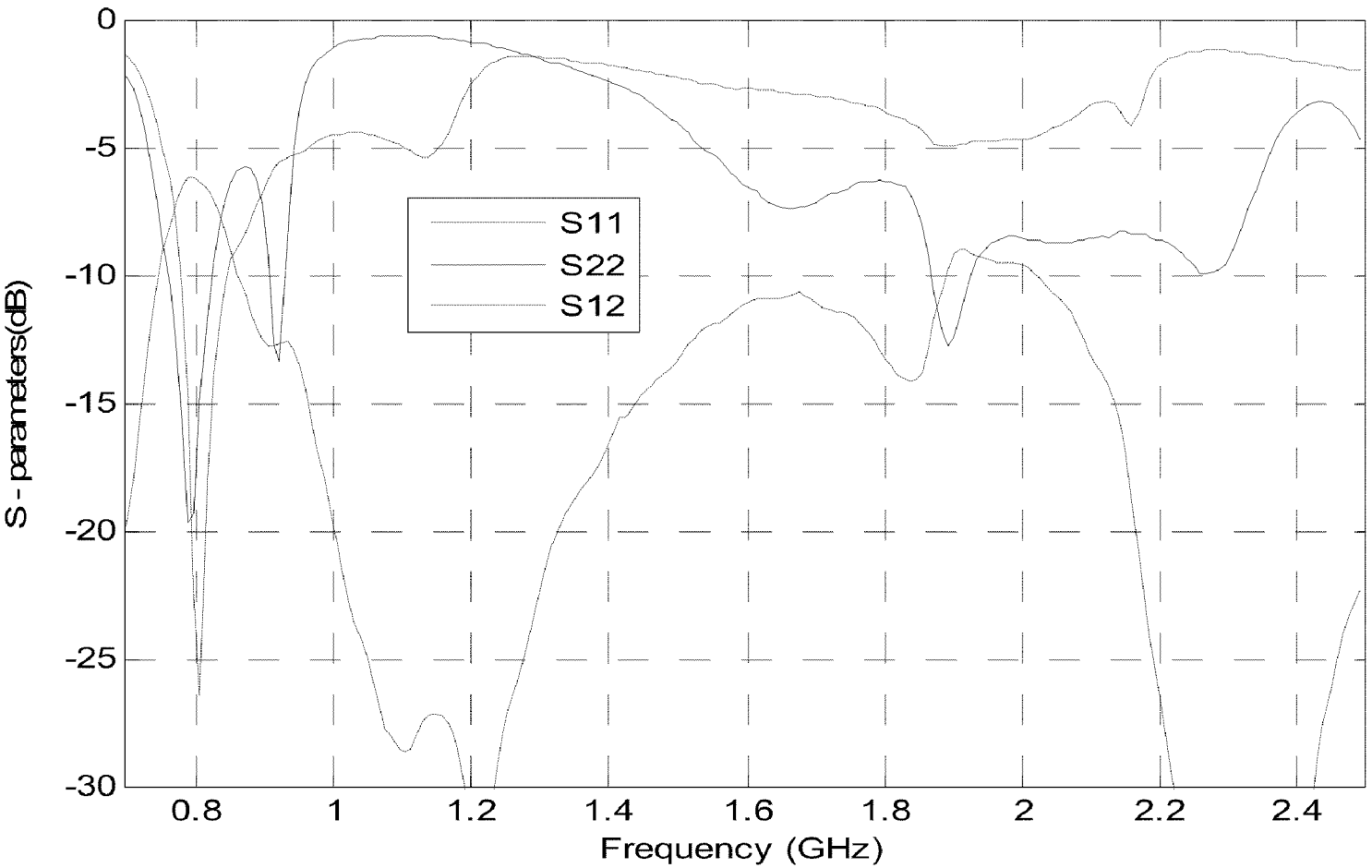
FIG. 20 shows the measured return loss for L-shaped MTM antenna 1, the measured return loss for L-shaped MTM antenna 2 and the isolation between these two antennas, indicated by dashed line (S11), solid line (S22) and dotted line (S12), respectively.

FIG. 20 shows the measured return loss of the L-shaped MTM antenna 1 1904, the measured return loss of the L-shaped MTM antenna 2 1908 and the isolation between these two antennas, indicated by dashed line (S11), solid line (S22) and dotted line (S12), respectively. Good matching is obtained for all three bands, LTE, CDMA and PCS, for the L-shaped MTM antenna 2 1908.

Figure 21:
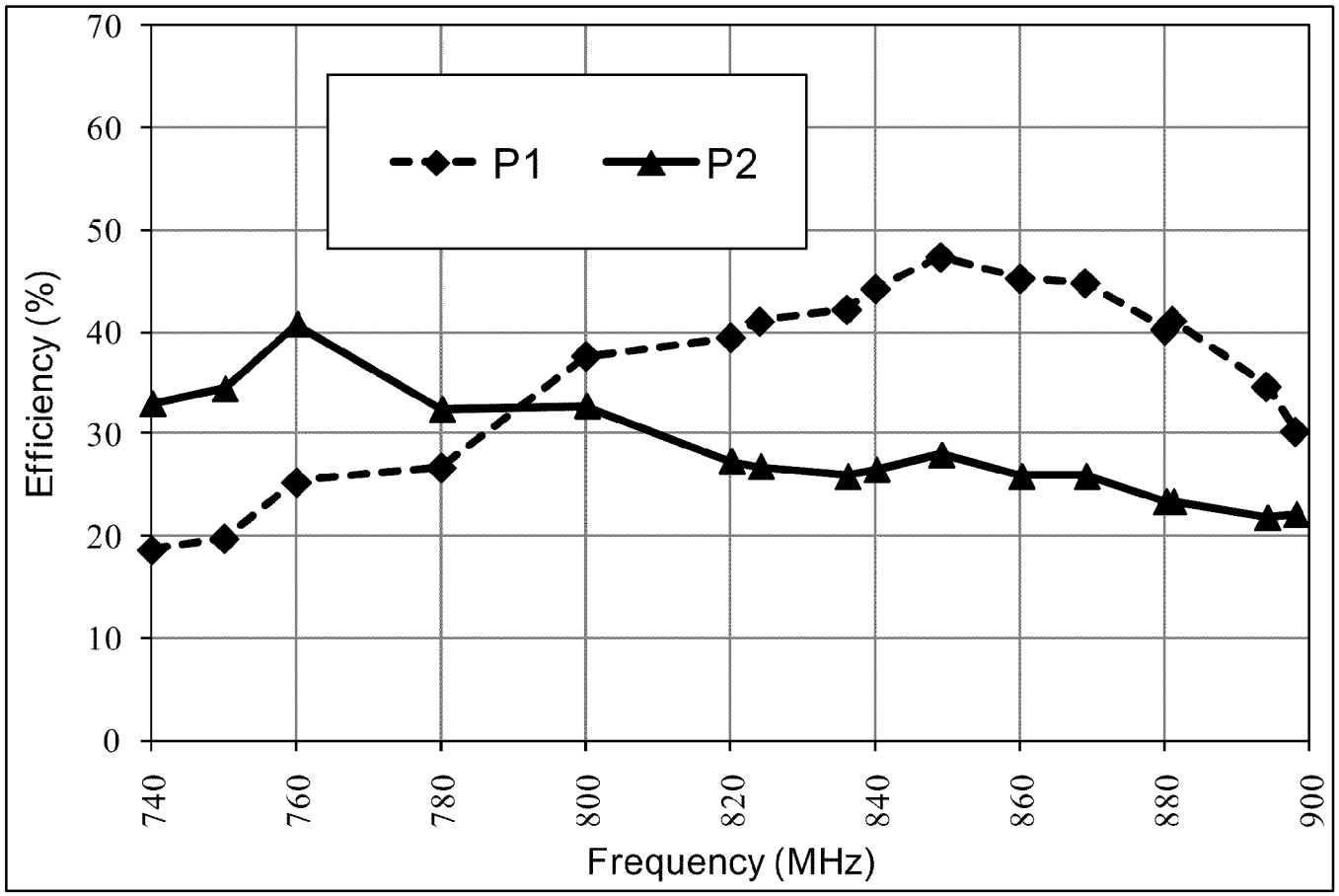
FIG. 21 shows the measured efficiency over the LTE and CDMA bands of the L-shaped MTM antenna 1 and the L-shaped MTM antenna 2, indicated by dashed line with diamonds (P1) and solid line with triangles (P2), respectively.

FIG. 21 shows the measured efficiency over the LTE and CDMA bands of the L-shaped MTM antenna 1 1904 and the L-shaped MTM antenna 2 1908, indicated by dashed line with diamonds (P1) and solid line with triangles (P2), respectively. Good efficiency is obtained for both antennas in spite of the small antenna size and the small ground plane.

Figure 22A:
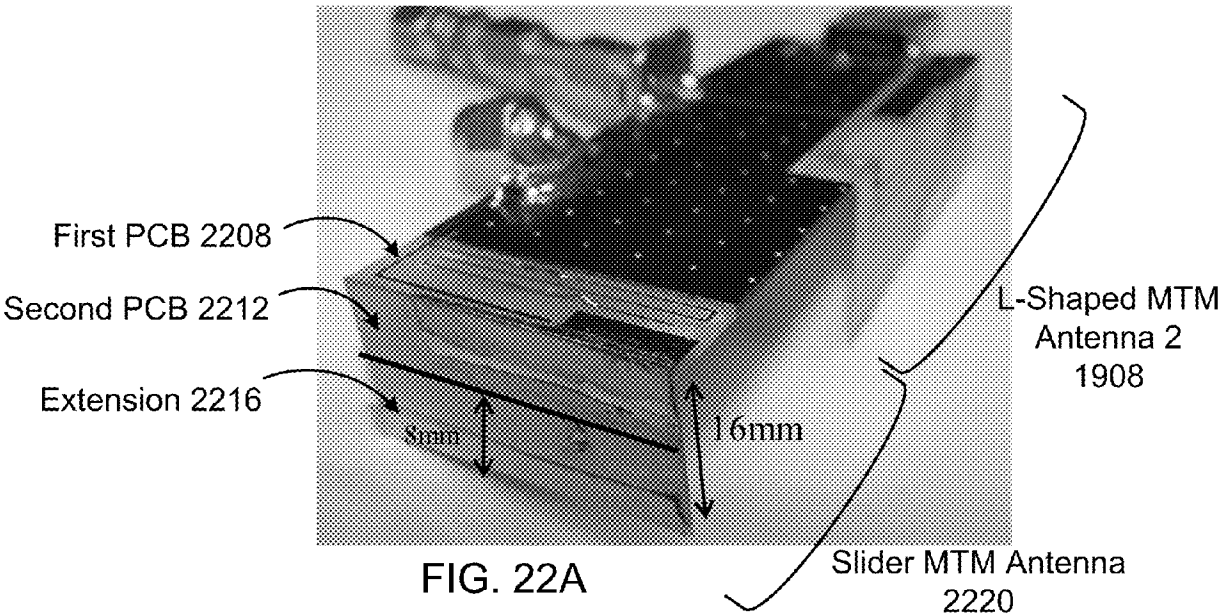
FIG. 22A shows a photo of the two-antenna device as shown in FIG. 19, in which the L-shaped MTM antenna 1 is replaced by an exemplary swivel MTM antenna.
Figure 22C:
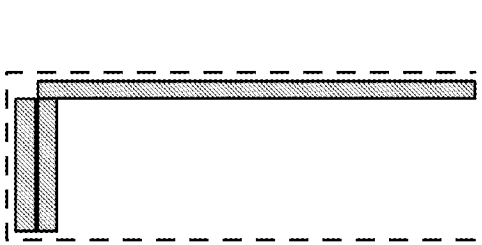
FIGS. 22B and 22C show the side view of the slider MTM antenna when the extension is slid out and when it is slid back in to overlap with the second PCB, respectively.
Figure 22B:
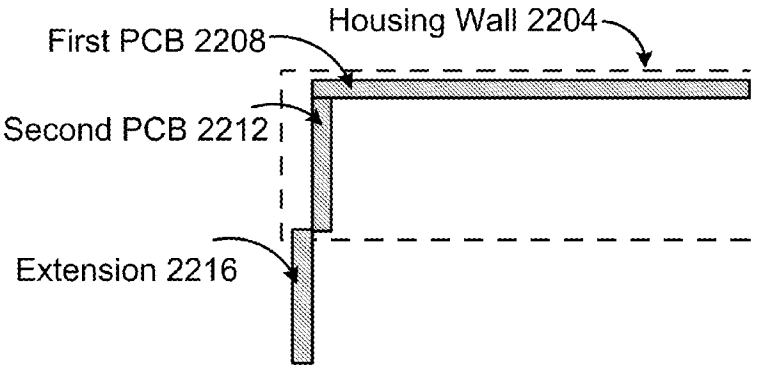

FIG. 22A shows a photo of a two-antenna device based on the design shown in FIG. 19 by replacing the L-shaped MTM antenna 1 1904 with a slider MTM antenna 2220. This slider MTM antenna 2220 has a structure similar to that of the L-shaped MTM antenna 1 1904 in FIG. 19, except that it has an extension 2216 to make the extended second PCB with a longer total length of 16 mm when the extension 2216 is coupled. The entire top surface of the extension 2216 is used to increase the cell patch area in this example. FIGS. 22B and 22C show the side view of the slider MTM antenna 2220 when the extension 2216 is slid out and when it is slid back in to overlap with the second PCB 2212, respectively. The extension 2216 can be accommodated inside the housing wall 2204 to save space when the antenna is unused. The spring contacts used to connect the first PCB 2208 and the second PCB 2212, as shown in FIGS. 18A-18C, can provide elasticity for the sliding-in-and-out actions.

Figure 23:
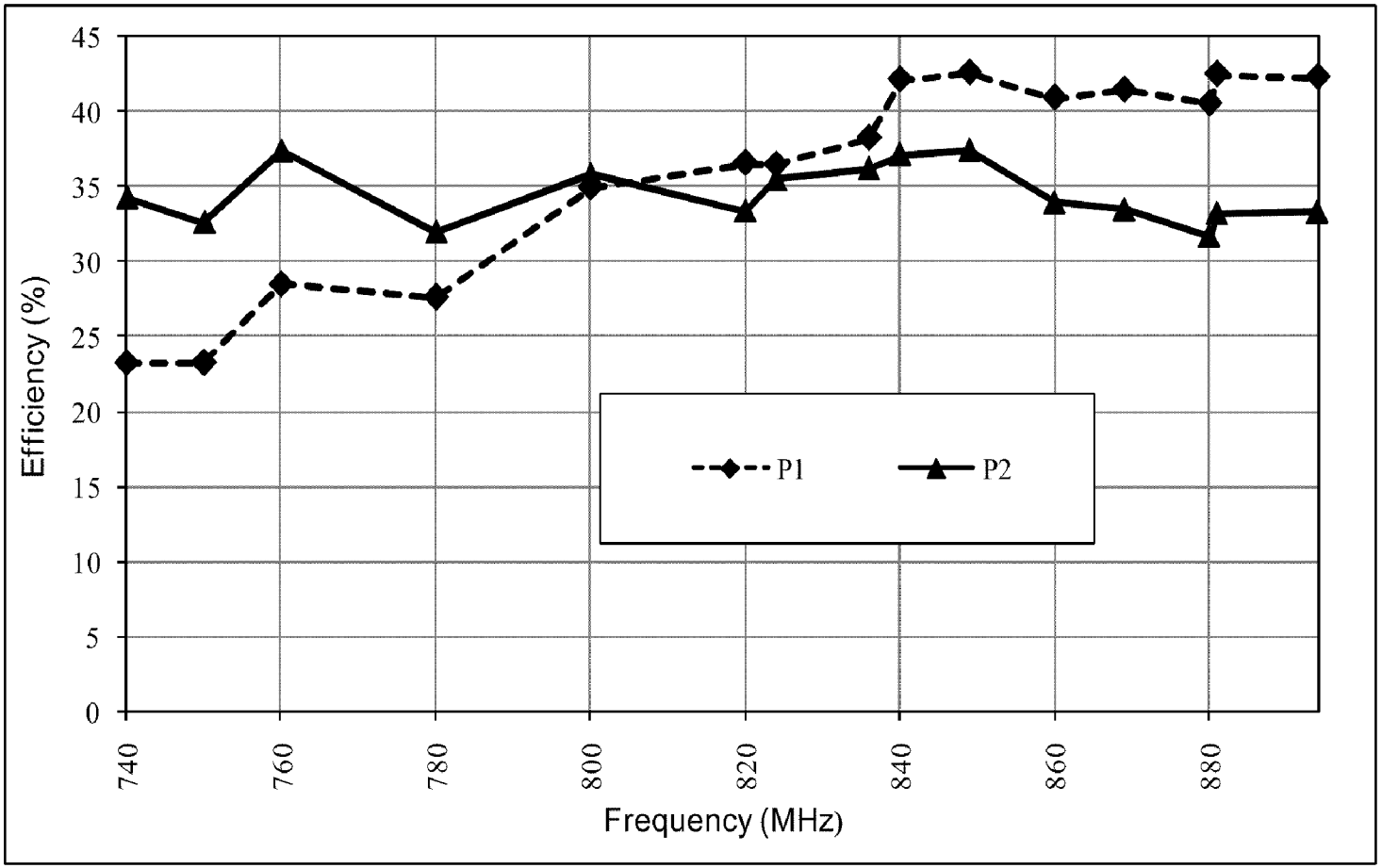
FIG. 23 shows the measured efficiency over the LTE and CDMA bands for the slider MTM antenna and the L-shaped MTM antenna 2, indicated by dashed line with diamonds (P1) and solid line with triangles (P2), respectively.

FIG. 23 shows the measured efficiency over the LTE and CDMA bands for the slider MTM antenna 2220 and the L-shaped MTM antenna 2 1908, indicated by dashed line with diamonds (P1) and solid line with triangles (P2), respectively. Good efficiency is obtained for both antennas in spite of the small antenna size and the small ground plane.

In some MTM antennas in non-planar configurations, the relative position or orientation of two different sections of the same antenna may be adjustable. For example, an antenna device can have a swivel arm that holds one antenna section to rotate relative to another antenna section. Such a device can include a device housing with walls forming an enclosure, a substrate inside the device housing and positioned closer to a wall than other walls to hold the first antenna section having one or more first antenna components electromagnetically coupled and arranged in a first plane substantially parallel to the first wall, and a second antenna section comprising one or more second antenna components electromagnetically coupled and arranged in a second plane different from the first plane. A swivel arm is provided as a platform on which the second antenna section is formed. The swivel arm includes a swivel block fixed in position relative to the substrate and provides a pivotal point around which the swivel arm rotates relative to the substrate to change the relative position and orientation between the first and second antenna sections. A joint antenna section is provided to connect the first and second antenna sections to form an MTM antenna supporting at least one resonance frequency in an antenna signal.

Figure 24B:
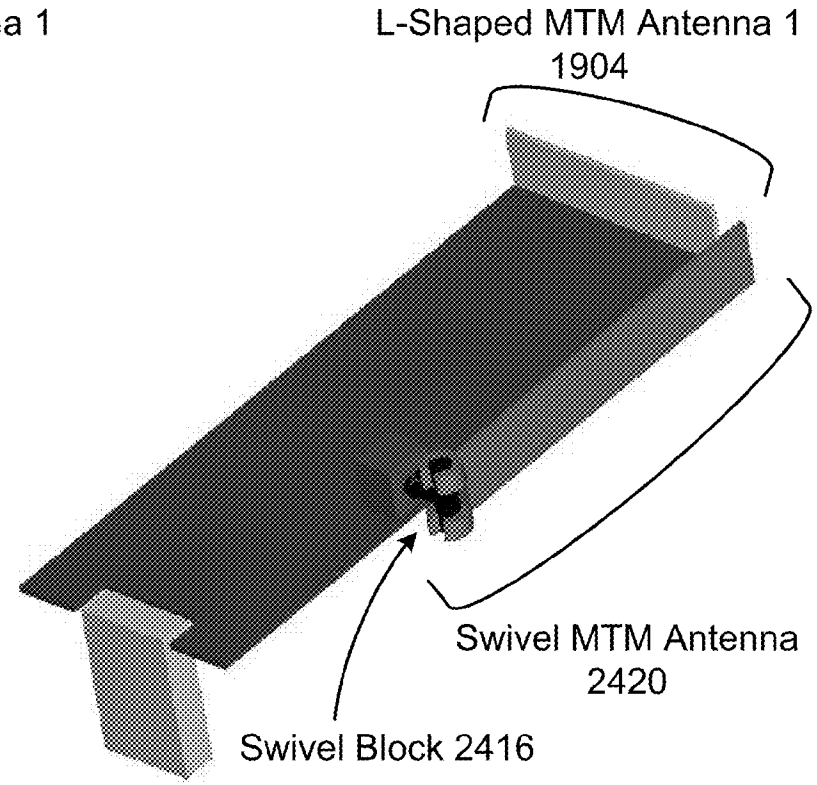
FIGS. 24A and 24B show the two-antenna device as shown in FIG. 19, in which the L-shaped MTM antenna 2 is replaced by an exemplary swivel MTM antenna, illustrating the upright configuration and the rotated configuration, respectively.
Figure 24A:
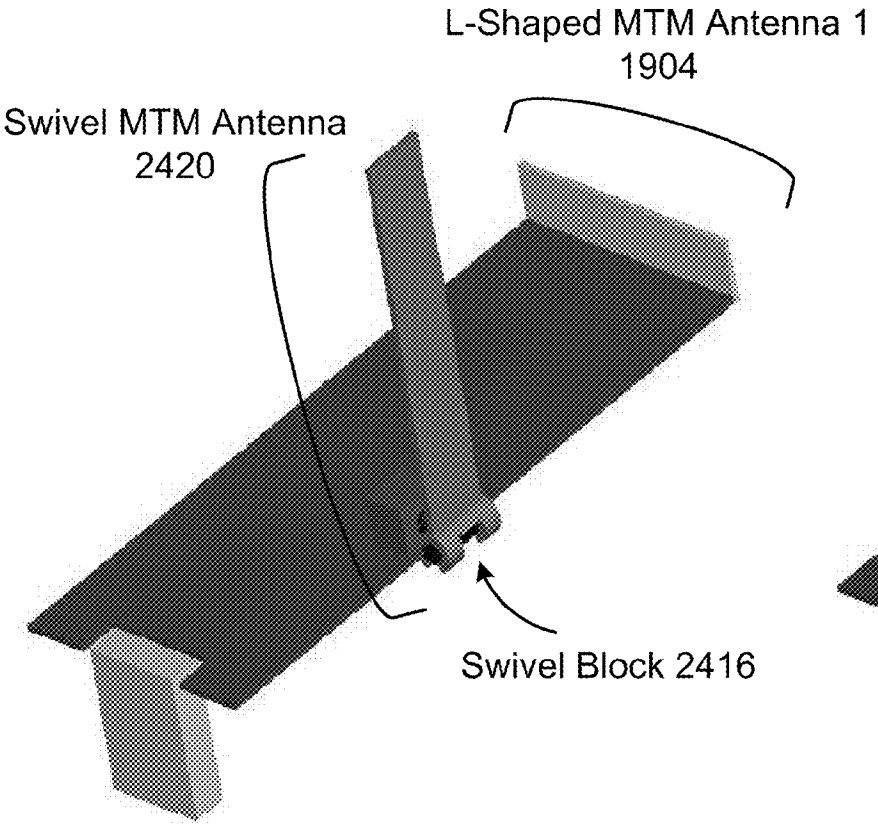

FIGS. 24A and 24B show another example of a non-planar MTM antenna structure. The L-shaped MTM antenna 2 1908 in the two-antenna device in FIG. 19 is replaced by an exemplary swivel MTM antenna 2420. FIG. 24A shows the upright configuration when the swivel MTM antenna 2420 is in use, and FIG. 24B shows the rotated configuration for storage when the swivel MTM antenna 2420 is not in use.

Figure 25B:
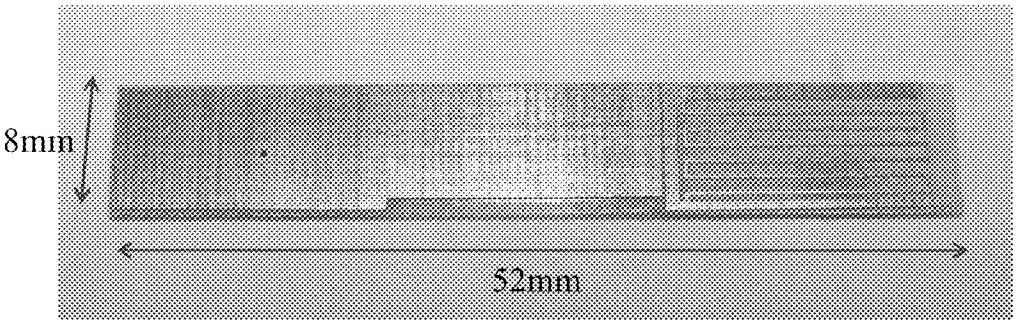
FIGS. 25B and 25C show photos of the top layer and bottom layer, respectively, of the second PCB of the swivel MTM antenna.
Figure 25C:
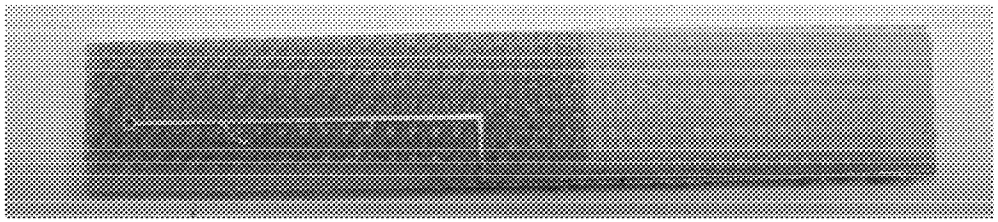
Figure 25A:
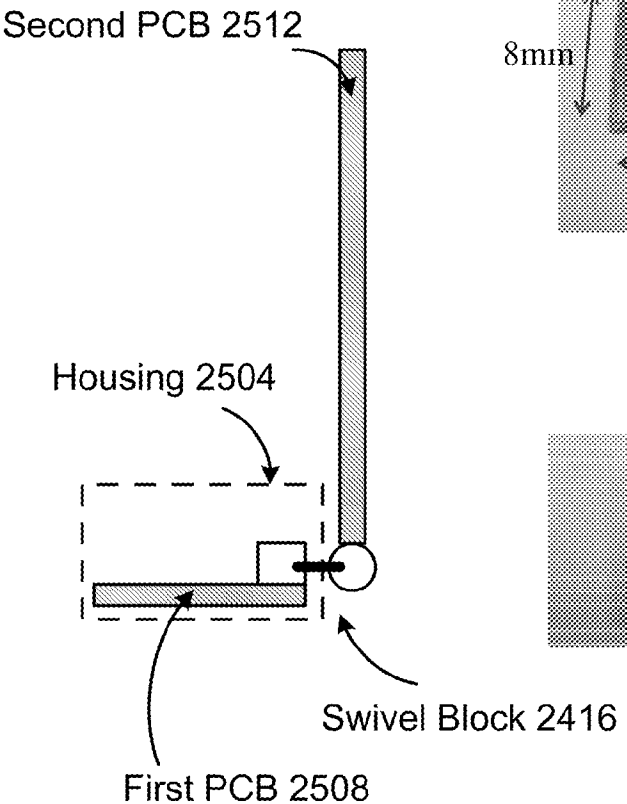
FIG. 25A shows the side view of the swivel antenna with the housing.

FIG. 25A shows the side view of the swivel MTM antenna 2420 with the housing 2504, illustrating that the swivel arm, i.e., the second PCB 2512, is attached to the first PCB 2508 through a swivel block 2416, which provides the mechanism for the swivel arm to turn around. A portion of the swivel block 2416 and the second PCB 2512 are placed outside the housing 2504 and the remaining portion of the swivel block 2416 and the first PCB 2508 are placed inside the housing 2504 in this example.

FIGS. 25B and 25C show photos of the top layer and bottom layer of the second PCB 2512, respectively. Most of the MTM antenna elements reside on the second PCB 2512. This is a DLM design using both sides of the board. Two conductive traces run through the swivel block 2416 and on the first PCB 2508, and are electrically connected to the conductive parts on the second PCB 2512. These two conductive traces are a first segment of the feed line connecting a feed port on the first PCB 2508 to a second segment of the feed line formed in the top layer of the second PCB 2512, and a first segment of the via line connecting the ground on the first PCB 2508 to a second segment of the via line formed in the bottom layer of the second PCB 2512. A meander line is attached to the feed line in the top layer of the second PCB 2512, where the feed line is electromagnetically coupled to the cell patch through a coupling gap. The cell patch in the top layer is connected to the via line in the bottom layer through a via formed in the second PCB 2512, hence to the ground. The cell patch is polygonal in shape. The width of the feed line is 0.5 mm, and that of the via line and meander line is 0.3 mm.

Figure 26:
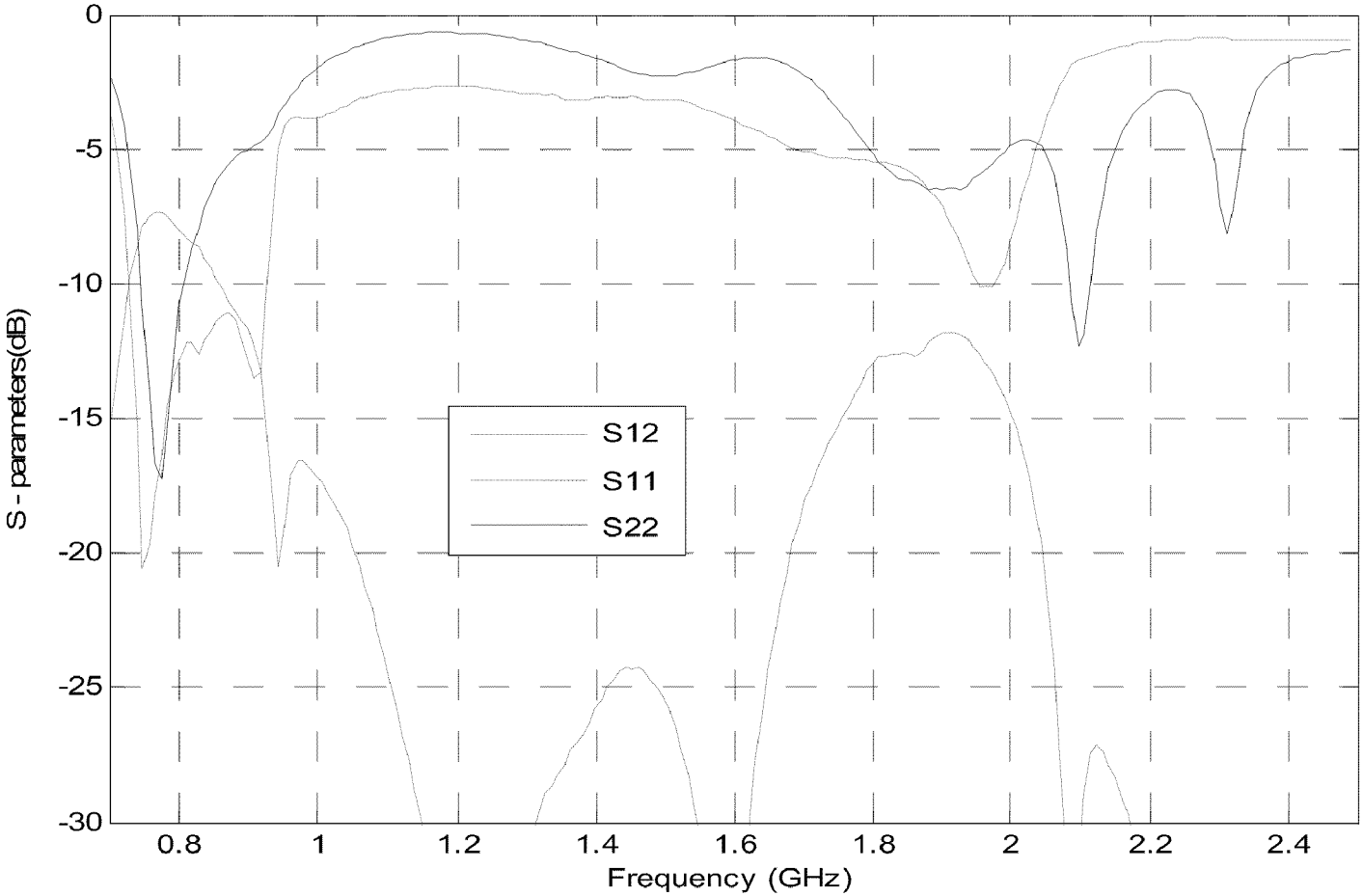
FIG. 26 shows the measured return loss of the L-shaped MTM antenna 1, the measured return loss of the swivel MTM antenna and the isolation between the two antennas, indicated by dashed line (S11), solid line (S22) and dotted line (S12), respectively.

FIG. 26 shows the measured return loss of the L-shaped MTM antenna 1 1904, the measured return loss of the swivel MTM antenna and the isolation between the two antennas, indicated by dashed line (S11), solid line (S22) and dotted line (S12), respectively. Good matching and isolation are obtained.

Figure 27A:
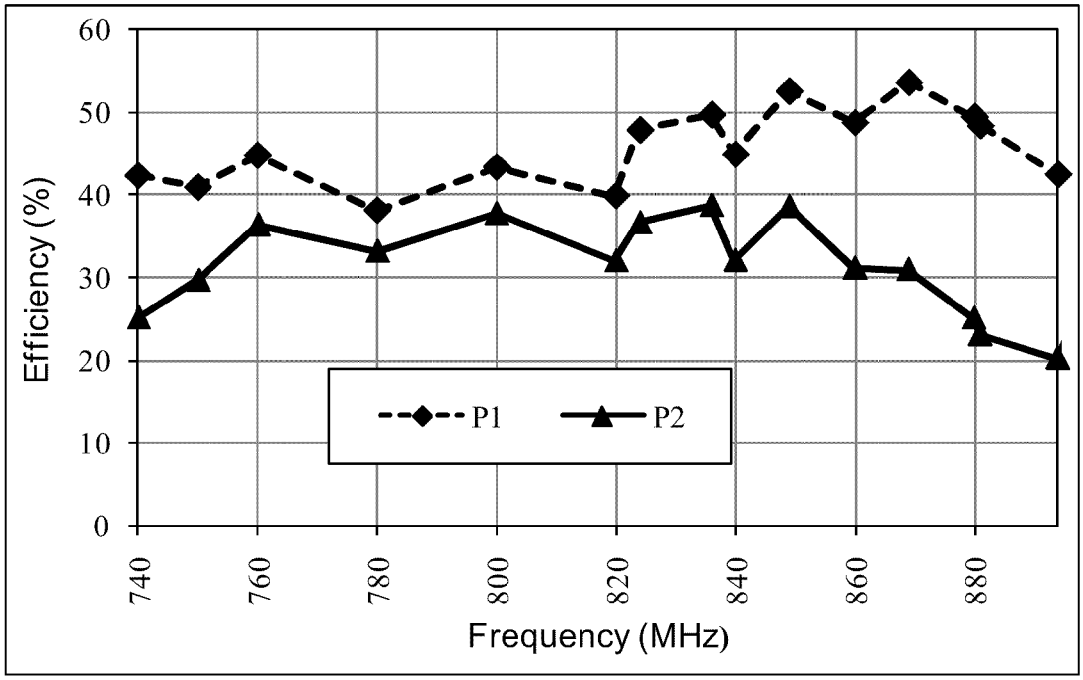
FIGS. 27A and 27B show the measured efficiency over the LTE and CDMA bands and over the PCS band, respectively, for the L-shaped MTM antenna 1 (dashed line with diamonds, P1) and the swivel MTM antenna (solid line with triangles, P2).
Figure 27B:
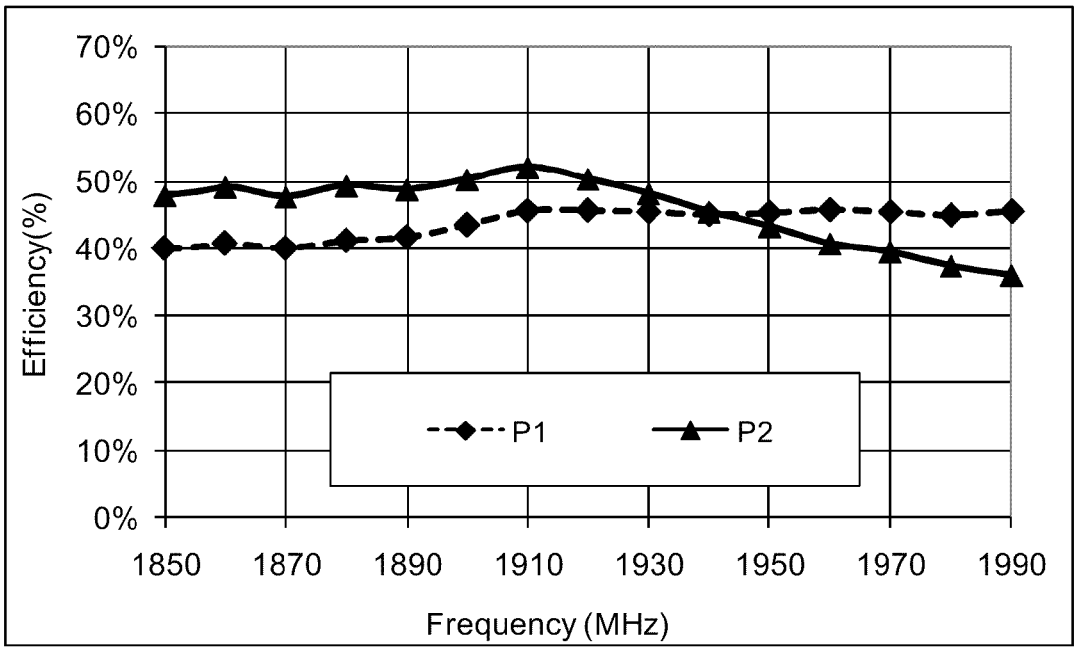

FIGS. 27A and 27B show the measured efficiency over the LTE and CDMA bands and over the PCS band, respectively, for the L-shaped MTM antenna 1 1904 (dashed line with diamonds, P1) and the swivel MTM antenna (solid line with triangles, P2). Good efficiency is obtained in spite of the small antenna size and the small ground plane.

Figure 28A:
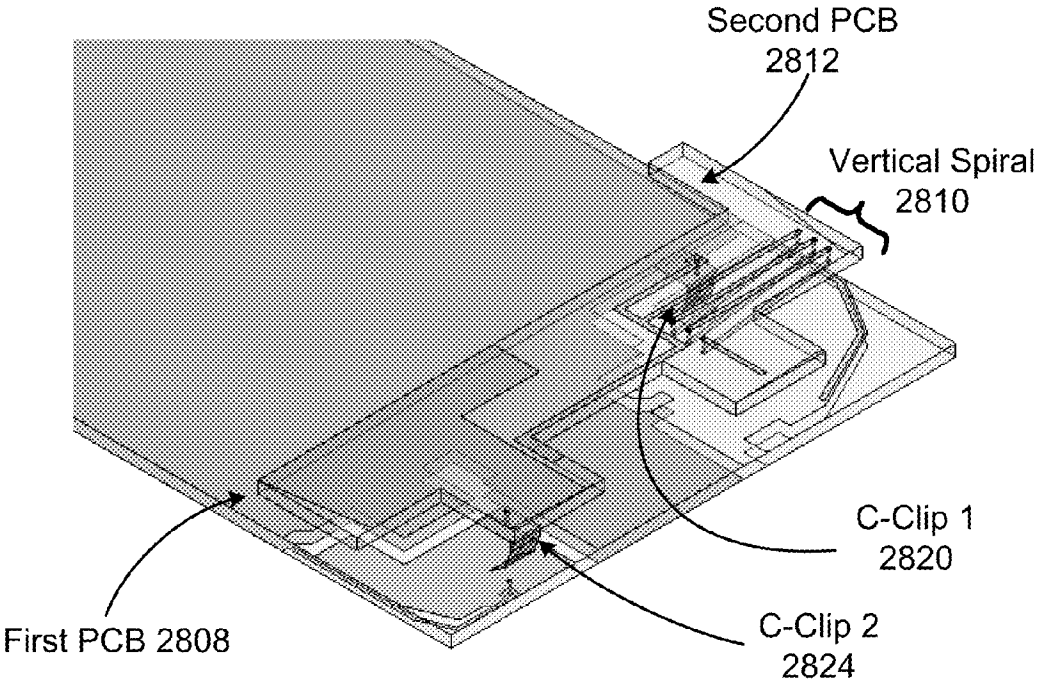
FIGS. 28A and 28B show the 3D view and side view, respectively, of an exemplary MTM paralleled structure.
Figure 28B:
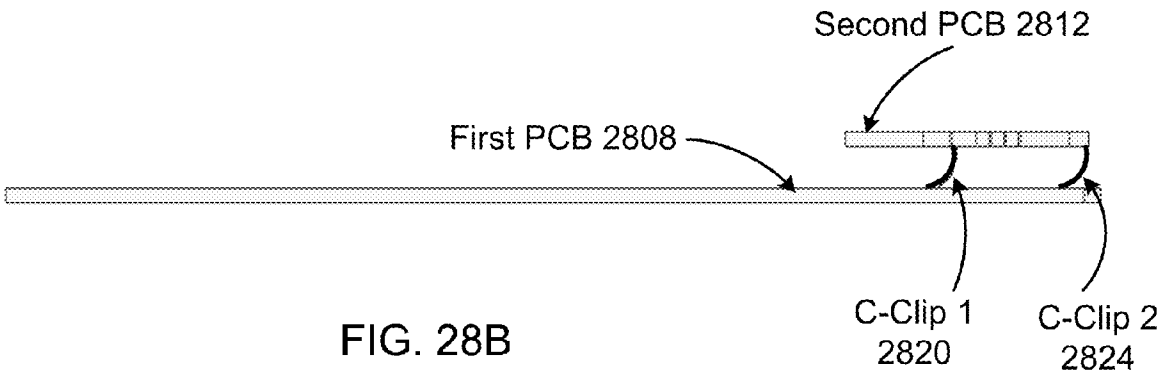

FIGS. 28A and 28B show yet another example of a non-planar structure, illustrating the 3D view and side view, respectively. This is an example of a paralleled MTM structure configured to save footprint by utilizing the third dimension, having the main board, i.e., the first PCB 2808 and the elevated board, i.e., the second PCB 2812, which is placed in parallel with the first PCB 2808. A dielectric spacer can be sandwiched between the two boards or left open with air gap. These two boards can be positioned by use of spring contacts such as C-clips or helical clips, pogo pins or Flex film pieces to provide mechanical and electrical contact. These parts can also give elasticity to the structure, thereby easing the assembly process. The use of C-clip 1 2820 and C-clip 2 2824 is depicted in this figure.

Figure 29:
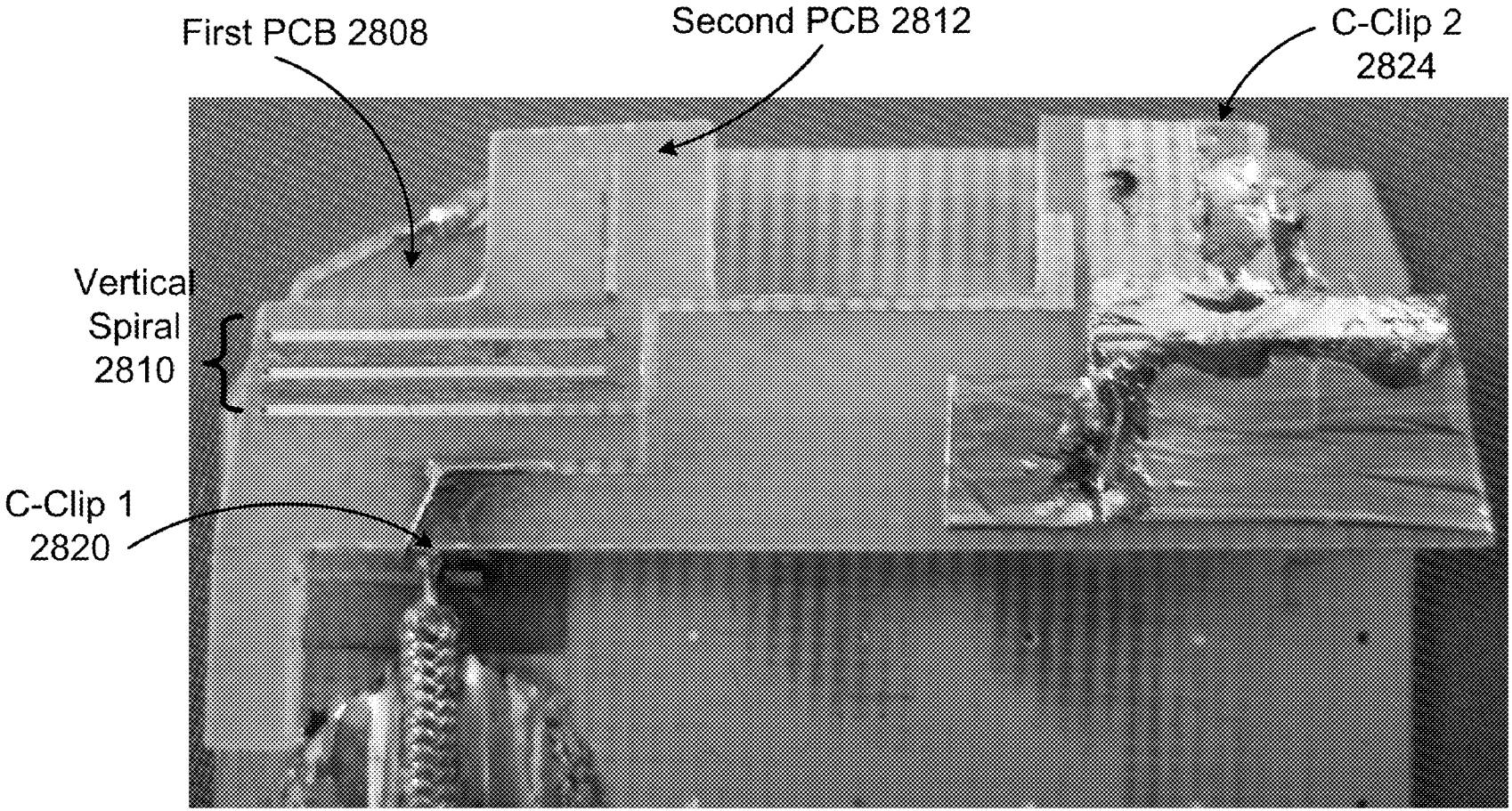
FIG. 29 shows a photo of the top view of the paralleled MTM structure.

FIG. 29 shows a photo of the top view of the paralleled MTM structure, focusing the top layer of the second PCB 2812. This MTM antenna is designed for penta-band cell phone applications. A feed port is formed in the top layer of the first PCB 2808 and is connected to C-lip 1 2820, which splits the path into two: one goes up to the feed line formed in the top layer of the second PCB 2812; and the other stays in the top layer of the first PCB 2808 as a conductive stub to induce a high-band monopole mode. The feed line is electromagnetically coupled to the cell patch through a coupling gap in the top layer of the second PCB 2812. A meander line is attached to the feed line to induce a low-band monopole mode. The meander line has a vertical spiral 2810 shape, having segments in the top layer and bottom layer of the second PCB 2812 with individual vias in the second PCB 2812 connecting the top and bottom segments. The cell patch is extended to the top layer of the first PCB 2808 by using C-clip 2 2824. A via is formed in the first PCB 2808 to connect the extended portion of the cell patch to the via line formed in the bottom layer of the first PCB 2828, where the via line is connected to the ground.

Figure 30:
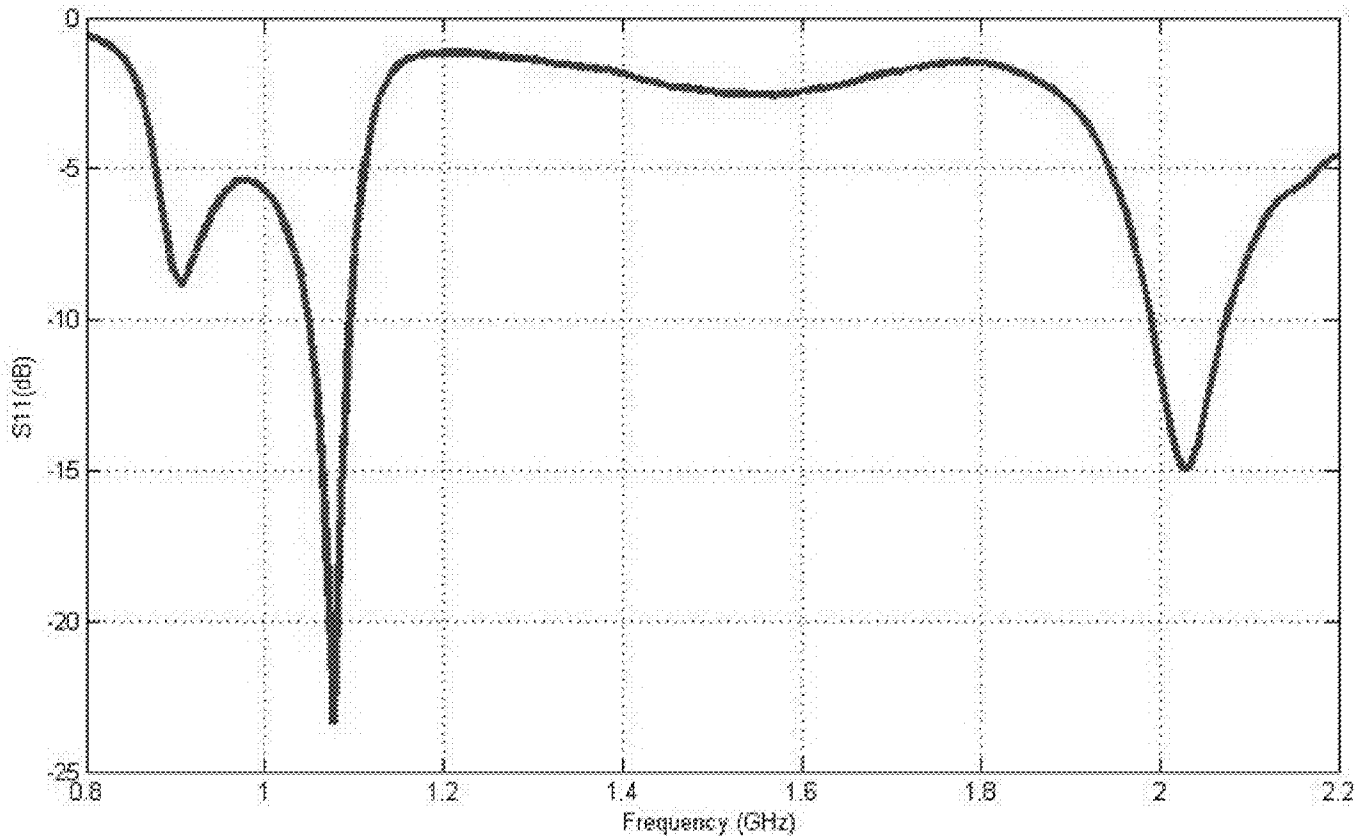
FIG. 30 shows the measured return loss of the paralleled MTM antenna.
Figure 31:
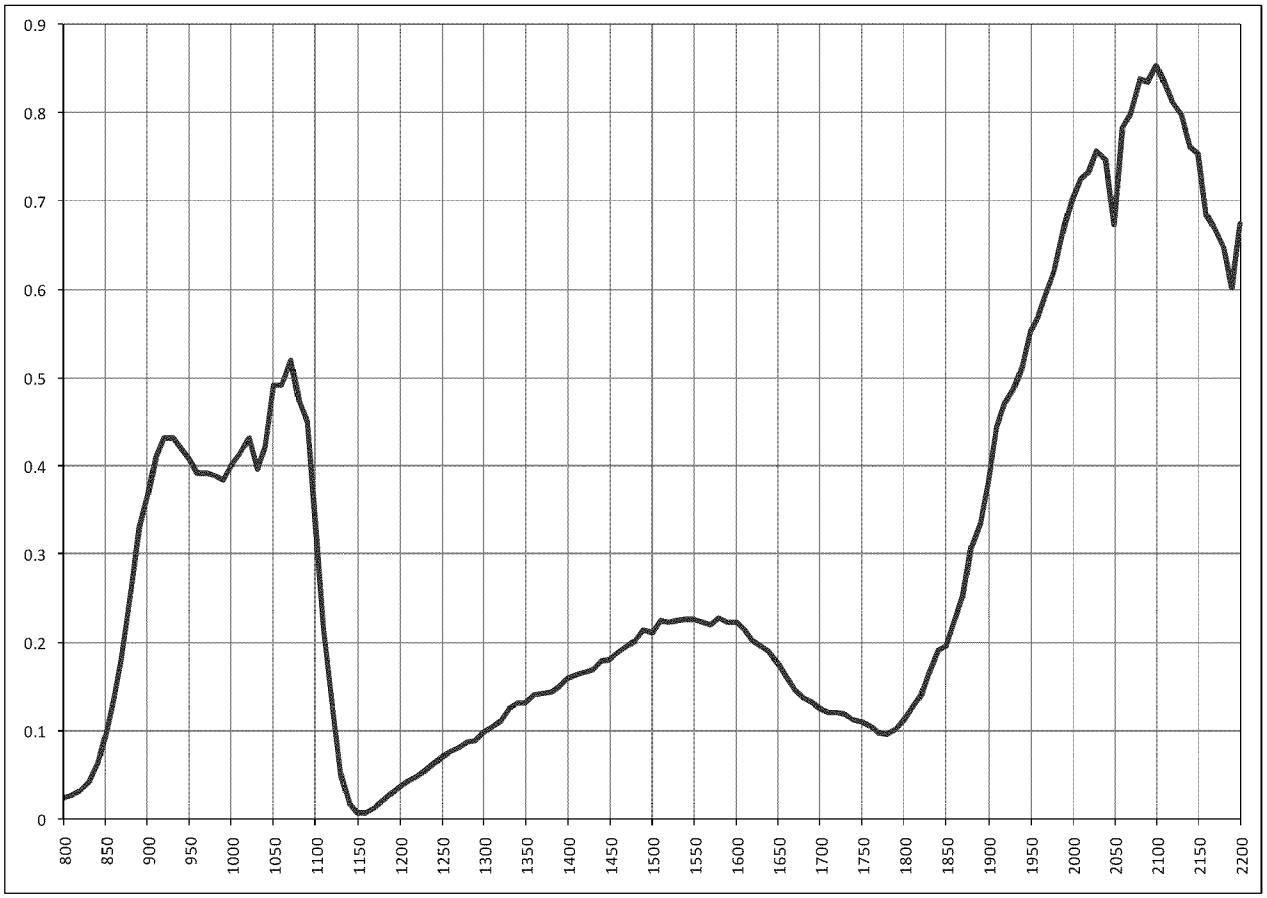
FIG. 31 shows the measured efficiency of the paralleled MTM antenna.

FIG. 30 shows the measured return loss of the paralleled MTM antenna. Matching is good for all five bands, taking into account the fact that the resonances tend to shift toward the lower frequency region when the MTM antenna is covered with a plastic housing. The measured efficiency shown in FIG. 31 is also good for all five bands.

A flexible material can be utilized to construct a non-planar MTM antenna. One continuous film or a combination of a flexible film and a rigid substrate, such as the FR-4 circuit board, can form a non-planar structure, which is bent at the corner formed by the first and second internal faces inside a device housing or over an antenna carrier or a device enclosure. Examples of such flexible materials include FR-4 circuit boards with a thickness less than 10 mils, thin glass materials, Flex films and thin-film substrates with a thickness of 3 mils-5 mils. Some of these materials can be bent easily with good manufacturability. Certain FR-4 and glass materials may require heat-bending or other techniques to achieve desired curved or bent shapes. In implementations, a flexible material can be used to form a flexible film or substrate on which the antenna components for the MTM antenna are formed.

Figure 32A:
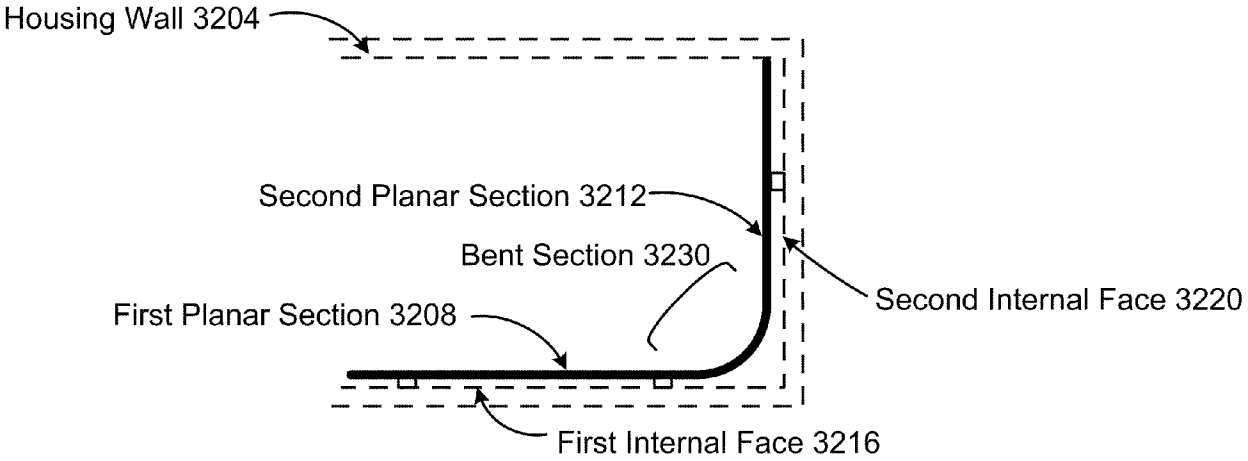
FIG. 32A shows the side view of an example of a flexible MTM antenna based on a continuous flexible material.

FIG. 32A shows the side view of an exemplary flexible MTM antenna based on a continuous flexible material such as a Flex film. The film is bent to have a bent section 3230 and two planar sections continuously connected, where the first planar section 3208 is in parallel with and in proximity to the first internal face 3216 of the housing wall 3204, and the second planar section 3212 is in parallel with and in proximity to the second internal face 3220 of the housing wall 3204. The bent film can be positioned inside the housing, for example, by pressing the top edge of the second planar section 3212 to the top housing wall during assembly. Thereafter, the entire film can be attached to the housing wall 3204 by use of solder, adhesive, heat-stick or other methods, as indicated by open rectangles in FIG. 32A.

Figure 32C:
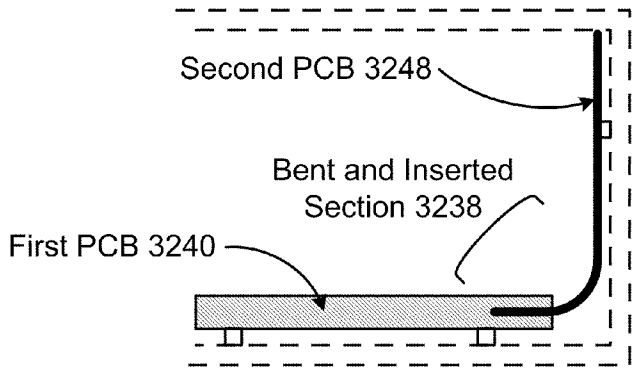
FIG. 32C shows the side view of a hybrid structure in which one end portion of a flexible substrate is inserted to a rigid substrate.
Figure 32B:
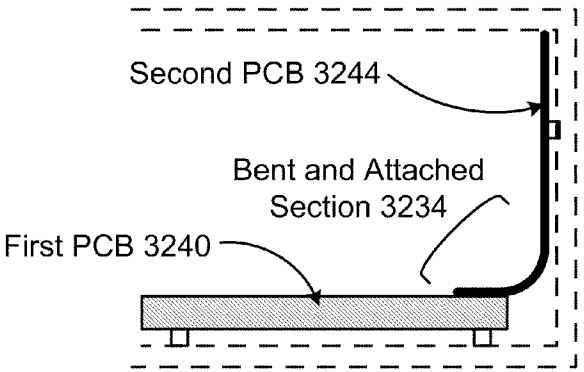
FIG. 32B shows the side view of a hybrid structure in which one end portion of a flexible substrate is attached to a rigid substrate.

FIGS. 32B and 32C show the side view of hybrid structures in which a rigid substrate such as an FR-4 circuit board is used for the first PCB 3240 that is in parallel with and in proximity to the first internal face 3216 of the housing wall 3204, and a flexible material such as a flexible film is used for the second PCB 3244 that is in parallel with and in proximity to the second internal face 3220 of the housing wall 3204. The film is bent to fit at the corner formed by the first and second internal faces 3216 and 3220 of the housing wall 3204. FIG. 32B shows an example in which the flexible film forms the second PBC 3244 supporting part of the antenna components of the MTM antenna and a bent section 3234 that has one end attached to the top surface of the rigid substrate, i.e., the first PCB 3240, to connect the antenna section on the first PCB 3240 and the antenna section on the second PCB 3244. The film can also be attached to the bottom surface.

FIG. 32C shows another hybrid structure where the edge portion of the flexible film, i.e., the second PCB 3248, is inserted between layers at the edge portion of the rigid substrate, i.e., the first PCB 3240, to form the bent section 3238 that connects to a metallization layer in the first PCB 3240 for connecting to the antenna components on the first PCB 3240. The film can be attached or inserted to the rigid substrate by use of solder, adhesive, heat-stick, spring contact or other suitable methods.

Figure 33:
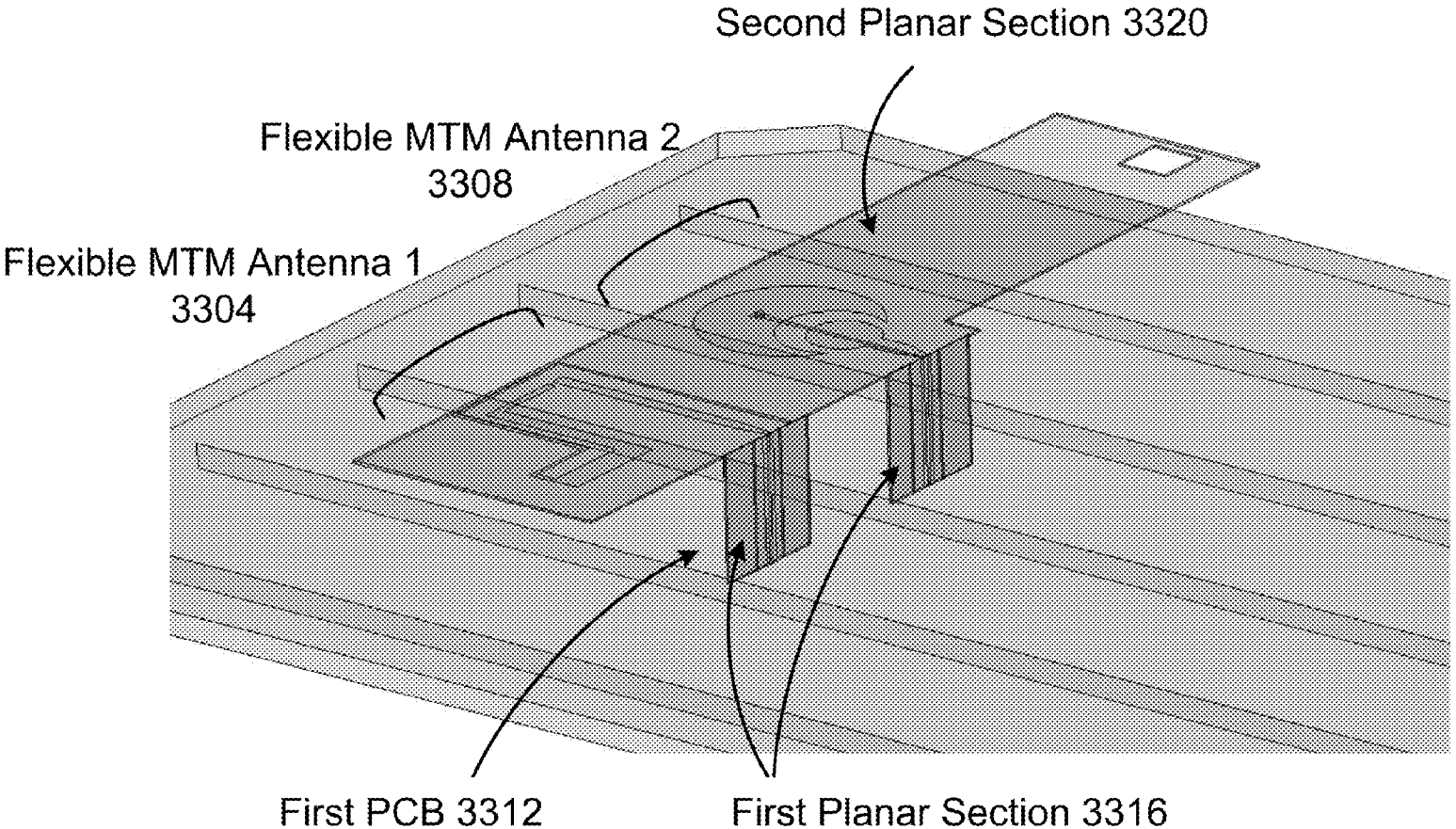
FIG. 33 shows the 3D view of another example of a flexible MTM antenna in which the flexible substrate is bent to have first and second planar sections.

FIG. 33 shows the 3D view of another example of a flexible MTM antenna structure. The second PCB includes a flexible material that is bent to have the first planar section 3316 and the second planar section 3320. One edge portion of the first planar section 3316 is attached or inserted to the first PCB 3312. The height of the first planar section 3316 can be selected so that the second planar section 3320 is positioned to be in parallel with and in proximity to the top roof of the device housing.

The exemplary flexible MTM structure in FIG. 33 includes two MTM antennas, the flexible MTM antenna 1 3304 and the flexible MTM antenna 2 3308, which are designed for GPS (1.575 GHz) and WiFi (2.4 GHz) applications, respectively. The flexible MTM antenna 1 3304 has a SLM structure, in which a feed line, cell patch and via line are all formed on one side of the second planar section 3320 of the second PCB. The flexible MTM antenna 2 3308 has a DLM structure, in which a feed line and cell patch are formed on one side of the second planar section 3320 of the second PCB, but a via line is formed on the other side and connected to the cell patch by a via penetrating through the second PCB. For each antenna, the feed line is connected to a feed port formed on the first planar section 3316 of the second PCB, and the via line is connected to the ground formed on the first planar section 3316 of the second PCB in this example. The feed port and the ground can continue to the first PCB 3312 through proper electrical connections or can be directly connected to the ground formed on the first PCB 3312. For each antenna, the feed line is electromagnetically coupled to the cell patch through a coupling gap to transmit a signal.

Figure 34:
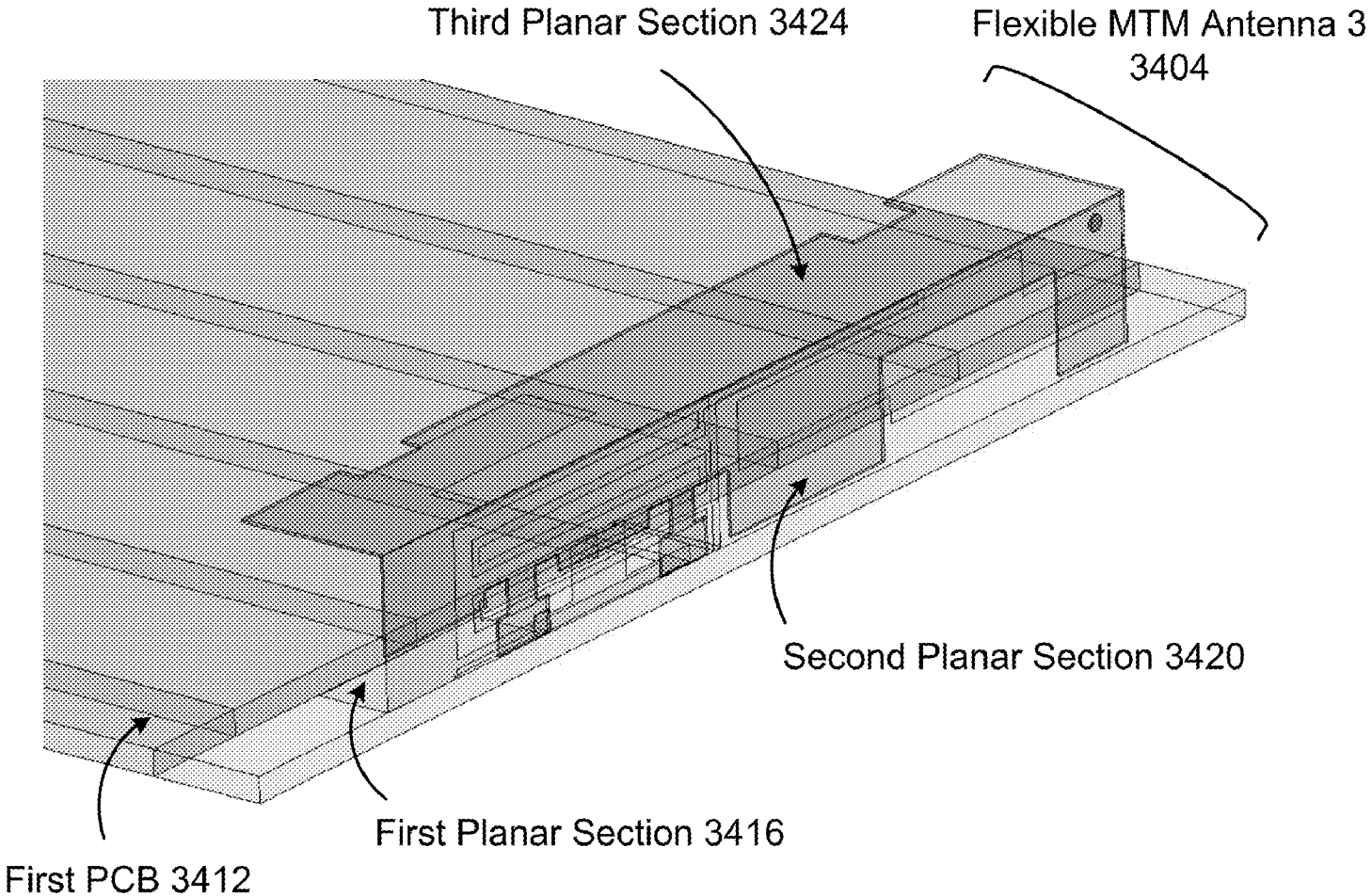
FIG. 34 shows the 3D view of yet another example of a flexible MTM antenna in which the flexible substrate is bent to have first, second and third planar sections.

FIG. 34 shows the 3D view of yet another example of a flexible MTM antenna structure. The second PCB is comprised of a flexible material that is bent to have the first planar section 3416, the second planar section 3420 and the third planar section 3424. One edge portion of the first planar section 3416 is attached or inserted to the first PCB 3412. The height of the second planar section 3420 can be adjusted so that the third planar section 3424 is positioned to be in parallel with and in proximity to the top roof of the device housing.

The exemplary flexible MTM antenna 3 in FIG. 34 is designed for penta-band (824 MHz-2170 MHz) cell phone applications. This antenna has a DLM structure, in which both sides of the second PCB are used to form the MTM antenna elements. A feed line is formed on one side of the first planar section 3416, extending to the second 3420 and third planar section 3424. One end of the feed line is connected to a feed port in the first PCB 3412, and the other end is electromagnetically coupled to a cell patch through a coupling gap to transmit a signal. The cell patch and feed line are polygonal in shape. A meander line is attached to the feed line to induce a monopole mode. A via is formed to penetrate through the second planar section 3420 to connect the cell patch to a via line, which is formed on the other side of the second planar section 3420 and continues to the first planar section 3416 and finally to the ground on the first PCB 3412.

Figure 35A:
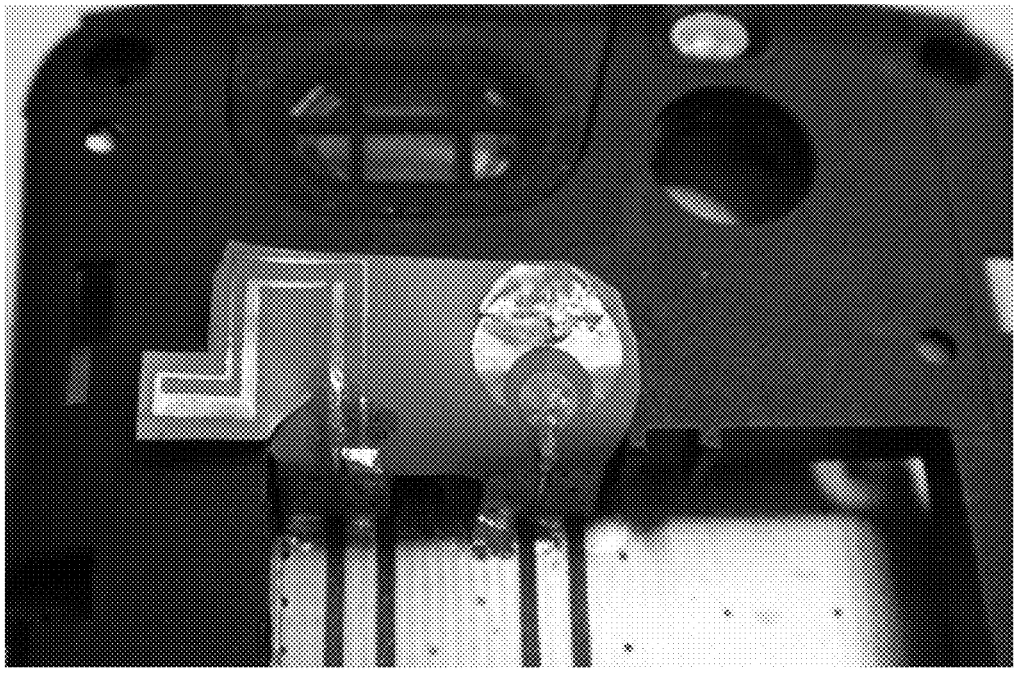
FIG. 35A shows a photo of the curved version of the flexible MTM structure in FIG. 33.
Figure 35B:
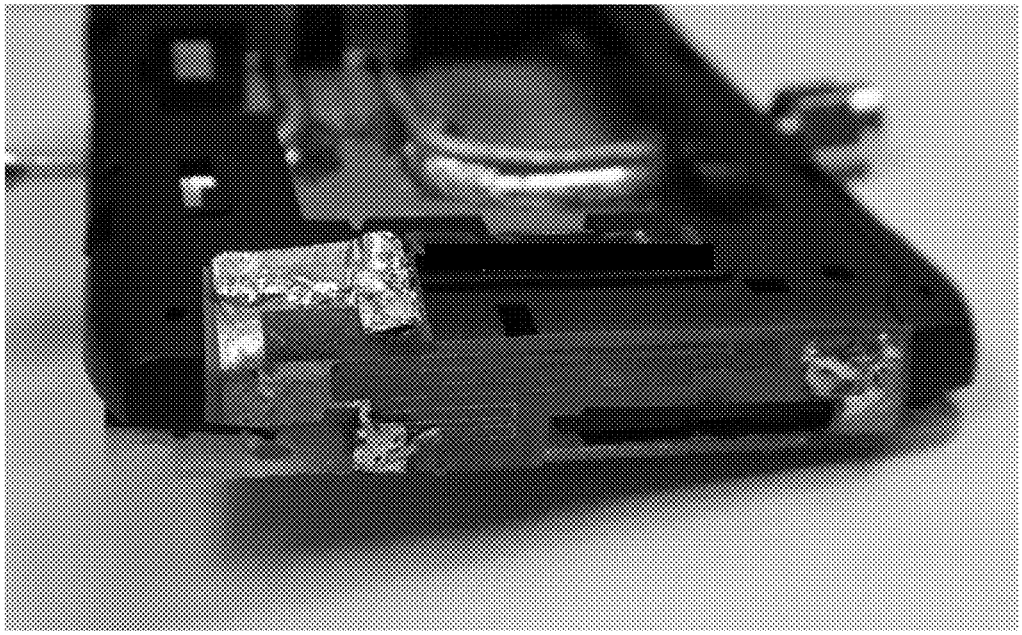
FIG. 35B shows a photo of the curved version of the flexible MTM structure in FIG. 34.

In the examples shown in FIGS. 33 and 34, the flexible substrate is bent to form a substantially right-angle corner between different planar sections. Instead of forming such sharp corners, the flexible substrate can be curved so as to fit in or over a curved enclosure. FIG. 35A shows a photo of the flexible structure, which is curved instead of being bent to form a sharp corner as shown in FIG. 33. The flexible MTM antennas 1 3304 and 2 3308 shown in FIG. 33 are curved over the antenna carrier, which is seen as a dark-color plastic in the photo. Likewise, FIG. 35B shows a photo of the flexible structure with the flexible MTM antenna 3 3404 as shown in FIG. 34, which is now curved to fit over the antenna carrier. Most of the non-metalized portions of the flexible substrates are cut and removed from the structures shown in these photos.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. Variations and enhancements of the described implementations and other implementations can be made based on what is described and illustrated in this document.

What is claimed is:

1. An antenna device structured to engage to a packaging structure, comprising:

a first antenna section configured to be in proximity to a first planar section of the packaging structure, the first antenna section comprising a first planar substrate, and at least one first conductive part associated with the first planar substrate;

a second antenna section configured to be with and in proximity to a second planar section of the packaging structure, the second antenna section comprising a second planar substrate, and at least one second conductive part associated with the second planar substrate; and a joint antenna section connecting the first and second antenna sections, wherein the at least one first conductive part, the at least one second conductive part and the joint antenna section are electromagnetically coupled to form a composite right and left handed (CRLH) metamaterial (MTM) antenna supporting at least one resonance frequency in an antenna signal and having a dimension less than one half of one wavelength of the resonance frequency.

2. The antenna device as in claim 1, wherein one edge portion of the second antenna section is attached to the first antenna section to form the joint antenna section including an edge line about which the first and second antenna sections form an angle.

3. The antenna device as in claim 2, wherein the angle is substantially 90 degrees, obtuse or acute.

4. The antenna device as in claim 1, wherein the first and second planar substrates comprise a rigid dielectric material.

5. The antenna device as in claim 1, wherein the first planar substrate comprises a rigid dielectric material and the second planar substrate comprises a flexible dielectric material.

6. The antenna device as in claim 5, wherein the second antenna section is bent near a corner formed by the first and second planar sections of the packaging structure, and the second antenna section includes a portion that is in proximity to the first planar section of the packaging structure.

7. The antenna device as in claim 6, wherein the portion of the second antenna section is substantially parallel to the first planar section of the packaging structure.

8. The antenna device as in claim 6, wherein the second antenna section is further bent near a corner formed by the second planar section and a third planar section of the packaging structure to have a portion that is in proximity to the third planar section of the packaging structure.

9. The antenna device as in claim 8, wherein the portion is substantially parallel to the third planar section of the packaging structure.

10. The antenna device as in claim 5, wherein one edge portion of the second antenna section is attached on a surface of the first antenna section to form the joint antenna section.

11. The antenna device as in claim 5, wherein one edge portion of the second antenna section is inserted between layers at one edge portion of the first antenna section to form the joint antenna section.

12. The antenna device as in claim 5, wherein the packaging structure is an antenna carrier, and the second antenna section is curved to be in proximity to at least a portion of an outer contour of the antenna carrier.

13. The antenna device as in claim 12, wherein the second antenna section is curved to be substantially parallel to the at least a portion of the outer contour of the antenna carrier.

14. The antenna device as in claim 1, wherein the first antenna section is configured to be substantially parallel to the first planar section of the packaging structure, and the second antenna section is configured to be substantially parallel to the second planar section of the packaging structure.

15. The antenna device as in claim 1, wherein the first and second antenna sections are placed substantially parallel to each other.

16. The antenna device as in claim 1, wherein the joint antenna section includes a spring contact that provides a mechanical and electrical connection between the first and second antenna sections and elasticity.

17. The antenna device as in claim 1, wherein the second antenna section is bent to have a portion configured to be in proximity to a third planar section of the packaging structure.

18. The antenna device as in claim 17, the portion is configured to be substantially parallel to the third planar section of the packaging structure.

19. The antenna device as in claim 1, wherein the joint antenna section includes a swivel block that enables rotation of the second antenna section.

20. The antenna device as in claim 19, wherein the swivel block enables the second antenna section to be rotated to a position in alignment with an edge of the first antenna section when the antenna device is not in operation.

21. The antenna device as in claim 1, further comprising a third antenna section that comprises a third planar substrate and at least one third conductive part, wherein a sliding block enables the third antenna section to slide in to substantially overlap with the second antenna section when the antenna device is not in operation, and to slide out with an electrical contact between the second and the third antenna sections for providing en extension to the second antenna section when the antenna device is in operation.

22. The antenna device as in claim 1, wherein the joint antenna section includes at least one electrical contact, and wherein the at least one first conductive part and the at least one second conductive part are configured to have a minimum number of the at least one electrical contact.

23. An antenna device structured to engage to an packaging structure, comprising:

a substrate having a flexible dielectric material; and two or more conductive parts associated with the substrate, the two or more conductive parts forming a composite right and left handed (CRLH) metamaterial structure configured to support at least one frequency resonance in an antenna signal, wherein the CRLH metamaterial structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

24. The antenna device as in claim 23, wherein the second antenna section is bent near a corner formed by the second planar section and a third planar section of the packaging structure to have a portion that is in proximity to the third planar section of the packaging structure.

25. The antenna device as in claim 23, wherein the packaging structure is an antenna carrier, and the second antenna section is curved to be in proximity to at least a portion of an outer contour of the antenna carrier.

26. The antenna device as in claim 23, wherein the first antenna section is configured to be substantially parallel to the first planar section of the packaging structure, and the second antenna section is configured to be substantially parallel to the second planar section of the packaging structure.

27. An antenna device, comprising:

a device housing comprising a plurality of walls forming an enclosure;

a first antenna part located inside the device housing and positioned closer to a first wall than other walls, the first antenna section comprising one or more first antenna components arranged in a first plane close to the first wall;

a second antenna part comprising one or more second antenna components arranged in a second plane different from the first plane;

a joint antenna part connecting the first and second antenna parts so that the one or more first antenna components of the first antenna part and the one or more second antenna components of the second antenna part are electromagnetically coupled to form a composite right and left handed (CRLH) metamaterial (MTM) antenna supporting at least one resonance frequency in an antenna signal and having a dimension less than one half of one wavelength of the resonance frequency.

28. The antenna device as in claim 27, wherein the first plane is positioned to be substantially parallel to the first wall.

29. The antenna device as in claim 27, wherein:

the second antenna part is located inside the device housing and positioned close to a second wall that is connected to the first wall to form an inner corner of the device housing.

30. The antenna device as in claim 29, wherein the second antenna part is positioned to be substantially parallel to the second wall.

31. The antenna device as in claim 29, comprising a first substrate close to the first wall, wherein the first antenna part is formed on the first substrate; and a flexible material on which the second antenna part and the joint antenna part are formed, the flexible material including (1) a first portion that is configured to support the joint antenna part and bent at the inner corner formed by the first and second walls to connect the first and second antenna parts and (2) a second portion configured to support the second antenna part.

32. The antenna device as in claim 31, wherein:

the first portion of the flexible material comprises a part that is attached to a surface of the first substrate to connect to the first antenna part.

33. The antenna device as in claim 31, wherein:

the first portion of the flexible material comprises a part that is inserted into the first substrate to connect to a metal layer between two opposing surfaces of the first substrate to connect to the first antenna part.

34. The antenna device as in claim 29, comprising:

a first substrate close to the first wall, wherein the first antenna part is formed on the first substrate; and a second substrate close to the second wall, wherein the second antenna part is formed on the second substrate.

35. The antenna device as in claim 34, wherein:

the joint antenna part between the first and second antenna parts includes one or more spring conductive contacts engaging the first and second substrates.

36. The antenna device as in claim 34, comprising:

an antenna extension electromagnetically coupled to the second antenna part formed on the second substrate as an extension of the MTM antenna and movably engaged to the second substrate to change a relative position to the second substrate.

37. The antenna device as in claim 34, wherein the first substrate is positioned to be substantially parallel to the first wall, and the second substrate is positioned to be substantially parallel to the second wall.

38. The antenna device as in claim 27, comprising:

a first substrate located inside a first wall of the device housing and close to the first wall, wherein the first antenna part is formed on the first substrate; and a swivel arm on which the second antenna part is formed, the swivel arm comprising a swivel block fixed in position relative to the first substrate and providing a pivotal point around which the swivel arm rotates relative to the first substrate to change the relative position and orientation between the first and second antenna parts.

39. The antenna device as in claim 38, wherein:

the second antenna part is outside the device housing.

40. The antenna device as in claim 38, wherein:

the second antenna part is partially outside the device housing.

41. The antenna device as in claim 27, comprising:

a flexible material on which the first antenna part, the joint antenna part and the second antenna part are formed, the flexible material including (1) a first portion configured to support the first antenna part, (2) a second portion configured to support the joint antenna part and bent to provide a transition between the first antenna part in the first plane and the second antenna part in the second plane, and (3) a third portion configured to support the second antenna part.

* * * * *